US008570248B2

(12) United States Patent
Origuchi et al.

(10) Patent No.: US 8,570,248 B2
(45) Date of Patent: Oct. 29, 2013

(54) PLASMA DISPLAY DEVICE AND METHOD OF DRIVING THE SAME

(75) Inventors: Takahiko Origuchi, Osaka (JP); Hidehiko Shoji, Osaka (JP)

(73) Assignee: Panasonic Corporation, Osaka (JP)

( * ) Notice: Subject to any disclaimer, the term of this patent is extended or adjusted under 35 U.S.C. 154(b) by 954 days.

(21) Appl. No.: 12/669,826

(22) PCT Filed: Jul. 10, 2008

(86) PCT No.: PCT/JP2008/001849

§ 371 (c)(1),
(2), (4) Date: Jan. 20, 2010

(87) PCT Pub. No.: WO2009/013862

PCT Pub. Date: Jan. 29, 2009

(65) Prior Publication Data

US 2010/0177088 A1 Jul. 15, 2010

(30) Foreign Application Priority Data

Jul. 25, 2007 (JP) ..... 2007-193313

(51) Int. Cl.
*G09G 3/28* (2013.01)

(52) U.S. Cl.
USPC ..... 345/63; 345/60; 345/690; 345/208

(58) Field of Classification Search
USPC ..... 345/60–69, 204, 211, 212, 214, 690
See application file for complete search history.

(56) References Cited

U.S. PATENT DOCUMENTS

| | | | | |
|---|---|---|---|---|
| 6,653,993 | B1 | 11/2003 | Nagao et al. | |
| 2003/0160742 | A1 | 8/2003 | Sakita | |
| 2004/0021622 | A1 | 2/2004 | Nagao et al. | |
| 2004/0196216 | A1 * | 10/2004 | Shindo et al. | 345/60 |
| 2005/0264479 | A1 | 12/2005 | Ito et al. | |
| 2006/0001600 | A1 | 1/2006 | Ito | |
| 2006/0244685 | A1 * | 11/2006 | Kim et al. | 345/67 |
| 2007/0222902 | A1 | 9/2007 | Yamate | |

(Continued)

FOREIGN PATENT DOCUMENTS

| | | |
|---|---|---|
| CN | 1855190 | 11/2006 |
| EP | 1717786 | 11/2006 |

(Continued)

OTHER PUBLICATIONS

English language Abstract of JP 2006-317811, Nov. 24, 2006.

(Continued)

*Primary Examiner* — Duc Dinh
(74) *Attorney, Agent, or Firm* — Greenblum & Bernstein, P.L.C.

(57) ABSTRACT

A voltage of sustain electrodes is lowered from Ve1 to a ground potential at a time point immediately before a first SF (sub-field). Then, a pulsed positive voltage is applied to data electrodes at a starting time point of a setup period of the first SF. Immediately before this, a large amount of negative wall charges is stored on the sustain electrodes and positive wall charges are stored on the data electrodes, and therefore application of the pulsed positive voltage to the data electrodes generates strong discharges between the sustain electrodes and the data electrodes. After that, application of a ramp voltage to scan electrodes is started at a time point, generating setup discharges between the scan electrodes and the sustain electrodes.

8 Claims, 25 Drawing Sheets

(56) References Cited

U.S. PATENT DOCUMENTS

| | | | |
|---|---|---|---|
| 2008/0055203 | A1 | 3/2008 | Nagao et al. |
| 2008/0062080 | A1 | 3/2008 | Nagao et al. |
| 2008/0062081 | A1 | 3/2008 | Nagao et al. |
| 2008/0062082 | A1 | 3/2008 | Nagao et al. |
| 2008/0062085 | A1 | 3/2008 | Nagao et al. |
| 2008/0068302 | A1 | 3/2008 | Nagao et al. |
| 2008/0068303 | A1 | 3/2008 | Nagao et al. |
| 2008/0079667 | A1 | 4/2008 | Nagao et al. |
| 2008/0150838 | A1 | 6/2008 | Nagao et al. |
| 2008/0165170 | A1 | 7/2008 | Nagao et al. |
| 2008/0165211 | A1 | 7/2008 | Shoji et al. |
| 2009/0079720 | A1 | 3/2009 | Murata et al. |
| 2009/0141462 | A1 | 6/2009 | Kitada et al. |
| 2009/0219272 | A1 | 9/2009 | Nakata et al. |
| 2010/0103161 | A1 | 4/2010 | Origuchi et al. |

FOREIGN PATENT DOCUMENTS

| | | |
|---|---|---|
| EP | 2063408 | 5/2009 |
| JP | 2000-148083 | 5/2000 |
| JP | 2002-351383 | 12/2002 |
| JP | 2003-15599 | 1/2003 |
| JP | 2003-248455 | 9/2003 |
| JP | 2003-255887 | 9/2003 |
| JP | 2005-338784 | 12/2005 |
| JP | 2006-18298 | 1/2006 |
| JP | 2006-317811 | 11/2006 |
| JP | 4388995 | 10/2009 |
| WO | 02/099778 | 12/2002 |
| WO | 2007/069598 | 6/2007 |
| WO | 2007/129641 | 11/2007 |
| WO | 2008/069209 | 6/2008 |
| WO | 2009/034681 | 3/2009 |
| WO | 2009/040983 | 4/2009 |

OTHER PUBLICATIONS

English language Abstract of JP 2003-248455, Sep. 5, 2003.
English language Abstract of JP 2005-338784, Dec. 8, 2005.
English language Abstract of JP 2006-18298, Jan. 19, 2006.
English language Abstract of JP 2000-148083, May 26, 2000.
English language Abstract of JP 2002-351383, Dec. 6, 2002.
English language Abstract of JP 2003-15599, Jan. 17, 2003.
U.S. Appl. No. 12/513,406 to Origuchi et al., filed May 4, 2009.
China Office Action, mailed Jul. 3, 2012, in counterpart Chinese patent application.
Japan Office Action for corresponding Japanese Patent Application, mailed Feb. 28, 2012.

* cited by examiner

PLASMA DISPLAY DEVICE AND METHOD OF DRIVING THE SAME

TECHNICAL FIELD

The present invention relates to a plasma display device that selectively causes a plurality of discharge cells to discharge to display an image and a method of driving the same.

BACKGROUND ART (Configuration of Plasma Display Panel)

An AC surface discharge type panel that is typical as a plasma display panel (hereinafter abbreviated as a "panel") includes a number of discharge cells between a front plate and a back plate arranged so as to face each other.

The front plate is constituted by a front glass substrate, a plurality of display electrodes, a dielectric layer and a protective layer. Each display electrode is composed of a pair of scan electrode and sustain electrode. The plurality of display electrodes are formed in parallel with one another on the front glass substrate, and the dielectric layer and the protective layer are formed so as to cover the display electrodes.

The back plate is constituted by a back glass substrate, a plurality of data electrodes, a dielectric layer, a plurality of barrier ribs and phosphor layers. The plurality of data electrodes are formed in parallel with one another on the back glass substrate, and the dielectric layer is formed so as to cover the data electrodes. The plurality of barrier ribs are formed in parallel with the data electrodes, respectively, on the dielectric layer, and the phosphor layers of R (red), G (green) and B (blue) are formed on a surface of the dielectric layer and side surfaces of the barrier ribs.

The front plate and the back plate are arranged to face each other such that the display electrodes intersect with the data electrodes in three dimensions, and then sealed. An inside discharge space is filled with a discharge gas. The discharge cells are formed at respective portions at which the display electrodes and the data electrodes face one another.

In the panel having such a configuration, a gas discharge generates ultraviolet rays, which cause phosphors of R, G and B to be excited and to emit light in each of the discharge cells. Accordingly, color display is performed.

A sub-field method is employed as a method of driving the panel. In the sub-field method, one field period is divided into a plurality of sub-fields, and the discharge cells are caused to emit light or not in the respective sub-fields, so that a gray scale display is performed. Each of the sub-fields has a setup period, a write period and a sustain period.

(Driving Method 1 of Conventional Panel)

In the setup period, a weak discharge (setup discharge) is performed to form wall charges required for a subsequent write operation in each discharge cell. In addition, the setup period has a function of generating priming for reducing a discharge time lag to stably generate a write discharge. Here, the priming means an excited particle that serves as an initiating agent for the discharge.

In the write period, scan pulses are applied to the scan electrodes in sequence while write pulses corresponding to image signals to be displayed are applied to the data electrodes. This selectively generates the write discharges between the scan electrodes and the data electrodes, causing the wall charges to be selectively formed.

In the subsequent sustain period, the sustain pulses are applied between the scan electrodes and the sustain electrodes a predetermined number of times corresponding to luminances to be displayed. Accordingly, discharges are selectively induced in the discharge cells in which the wall charges have been formed by the write discharges, causing the discharge cells to emit light.

Here, respective voltages applied to the scan electrodes, the sustain electrodes and the data electrodes are adjusted in order to generate the weak discharges in the discharge cells in the foregoing setup period.

Specifically, a ramp voltage gradually rising is applied to the scan electrodes while the voltage of the data electrodes is held at a ground potential (a reference voltage) in the first half of the setup period (hereinafter referred to as a rise period). This generates the weak discharges between the scan electrodes and the data electrodes and between the sustain electrodes and the data electrodes in the rise period.

Moreover, a ramp voltage gradually dropping is applied to the scan electrodes while the voltage of the data electrodes is held at the ground potential in the second half of the setup period (hereinafter referred to as a drop period). This generates the weak discharges between the scan electrodes and the data electrodes and between the sustain electrodes and the data electrodes in the drop period.

As described above, Patent Document 1, for example, discloses the method of driving the panel in which the ramp voltage or the voltage gradually rising or dropping is applied to the scan electrodes during the setup period. Thus, the wall charges stored on the scan electrodes and sustain electrodes are erased, and the wall charges required for the write operation are stored on each of the scan electrodes, the sustain electrodes and the data electrodes.

In practice, however, strong discharges may be generated between the scan electrodes and the data electrodes in the rise period. In this case, the strong discharges are generated between the scan electrodes and the sustain electrodes to generate a large amount of wall charges and a large amount of priming in the discharge cells, resulting in a higher possibility of the strong discharges to be generated also in the drop period.

The generation of the strong discharges in the setup period erases the wall charges stored on the scan electrodes, the sustain electrodes and the data electrodes. Thus, an appropriate amount of wall charges required for the write discharges cannot be formed on each electrode.

Therefore, Patent Document 2 discloses a method of driving the panel that prevents the generation of the strong discharges in the setup period.

(Driving Method 2 of Conventional Panel)

FIG. 24 shows examples of driving voltage waveforms (hereinafter referred to as driving waveforms) of the panel employing a method of driving the panel of Patent Document 2. FIG. 24 shows the waveforms of driving voltages applied to the scan electrodes, the sustain electrodes and the data electrodes, respectively, in the sustain period, the setup period and the write period.

As shown in FIG. 24, the data electrodes are held at a voltage Vd that is higher than the ground potential in the rise period of the setup period.

In this case, a voltage between the scan electrodes and the data electrodes is smaller than that when the data electrodes are held at the ground potential. Accordingly, a voltage between the scan electrodes and the sustain electrodes exceeds a discharge start voltage before the voltage between the scan electrodes and the data electrodes exceeds the discharge start voltage.

As described above, the weak discharges are induced between the scan electrodes and the sustain electrodes at an earlier timing, thereby generating the priming in the rise period. After that, the weak discharges are induced between the scan electrodes and the data electrodes, so that the wall charges required for the write operation are formed on each of the scan electrodes, the sustain electrodes and the data electrodes.

For example, the negative wall charges are stored on the scan electrodes and the positive wall charges are stored on the data electrodes when the write period shown in FIG. 24 is started. This results in stable write discharges in the write period.

[Patent Document 1] JP 2003-15599 A

[Patent Document 2] JP 2006-18298 A

DISCLOSURE OF THE INVENTION

Problems to be Solved by the Invention

In recent years, the number of discharge cells has been increased (an increase of pixels) while distances between adjacent discharge cells have been reduced with a larger screen and higher precision of a panel. As a result, crosstalk is liable to occur between the adjacent discharge cells, as will be described below.

As shown in FIG. 24, the voltage of the sustain electrodes is raised after a predetermined period of time (a phase difference TR) from the last rise of the voltage of the scan electrodes to Vcl in a preceding sub-field. This induces erase discharges between the scan electrodes and the sustain electrodes, and the positive wall charges stored on the scan electrodes and the negative wall charges stored on the sustain electrodes are erased or reduced.

Next, the ramp voltage gradually rising is applied to the scan electrodes while the data electrodes are held at the voltage Vd in the rise period of the setup period. Thus, the weak discharges are generated between the scan electrodes and the sustain electrodes, and the weak discharges are subsequently generated between the scan electrodes and the data electrodes. As a result, the negative wall charges are stored on the scan electrodes, and the positive wall charges are stored on the sustain electrodes. At this time, the positive wall charges are stored on the data electrodes.

In the drop period of the setup period, the ramp voltage gradually dropping is applied to the scan electrodes while the data electrodes are held at the ground potential. This generates the weak discharges between the scan electrodes and the data electrodes and between the sustain electrodes and the data electrodes. This results in the reduced negative wall charges stored on the scan electrodes and the reduced positive wall charges stored on the sustain electrodes. At this time, the positive wall charges are stored on the data electrodes.

In this manner, the negative wall charges are stored on the scan electrodes and the positive wall charges are stored on the data electrodes when the write period is started. In this state, negative-polarity write pulses are applied to the scan electrodes and positive-polarity write pulses are applied to the data electrodes in the write period. In this case, the foregoing wall charges increase the voltage between the scan electrodes and the data electrodes, thus stably generating the write discharges between the scan electrodes and the data electrodes.

At this time, since the positive wall charges are stored on the sustain electrodes, large write discharges are generated between the scan electrodes and the sustain electrodes. Accordingly, when the distances between the adjacent discharge cells are small, crosstalk is liable to occur between the adjacent discharge cells to cause erroneous discharges. Therefore, a method of driving the panel described below has been put into practical use in order to prevent such an occurrence of crosstalk.

(Driving Method 3 of Conventional Panel)

FIG. 25 shows examples of the driving waveforms of the panel for preventing the crosstalk from occurring between the adjacent discharge cells. Note that also in this example, the data electrodes are held at the voltage Vd that is higher than the ground potential in the rise period of the setup period.

In the driving waveforms of FIG. 25, the phase difference TR for the erase discharges is smaller than that in the driving waveforms of FIG. 24. The smaller phase difference TR results in the weaker erase discharges. Therefore, in the driving waveforms of FIG. 25, the erase discharges are weaker than those in the driving waveforms of FIG. 24 to cause more of positive wall charges to remain on the scan electrodes and more of negative wall charges to remain on the sustain electrodes before the setup period. This allows the write discharges in the write period to be weakened. As a result, it is considered that the crosstalk between the adjacent discharge cells can be prevented.

According to the experiments conducted by the inventor, however, it was found that the following phenomenon would occur in practice. As shown in FIG. 25, a ramp voltage gradually rising from a voltage Vm by a voltage Vset is applied to the scan electrodes, the sustain electrodes are held at the ground potential, and the data electrodes are held at the voltage Vd that is higher than the ground potential in the rise period of the setup period.

As described above, a large amount of positive wall charges is stored on the scan electrodes and a large amount of negative wall charges is stored on the sustain electrodes before the setup period. Therefore, when the voltage Vm is applied to the scan electrodes, the strong discharges are generated between the sustain electrodes and the data electrodes, thus generating the strong discharges between the scan electrodes and the sustain electrodes accordingly.

Such strong discharges are generated to erase the wall charges stored on the scan electrodes, the sustain electrodes and the data electrodes. Thus, the voltage between the scan electrodes and the sustain electrodes does not exceed the discharge start voltage even though the ramp voltage rising by the voltage Vset is applied to the scan electrodes, so that the weak discharges cannot be generated between the scan electrodes and the sustain electrodes.

Therefore, it is difficult to adjust the wall charges on the scan electrodes, the sustain electrodes and the data electrodes to amounts required for the write discharges in the write period.

Therefore, it is considered that the ramp voltage applied to the scan electrodes is increased in order to generate the weak discharges after the generation of the foregoing strong discharges. However, this results in higher cost of a driving circuit.

An object of the present invention is to provide a plasma display device capable of preventing the crosstalk from occurring between the adjacent discharge cells and forming desired amounts of wall charges on the plurality of electrodes constituting the discharge cells and a method of driving the same.

Means for Solving the Problems (1) According to an aspect of the present invention, a plasma display device that drives a plasma display panel including a plurality of discharge cells at intersections of a scan electrode and a sustain electrode with a plurality of data electrodes by a sub-field method in which one field period includes a plurality of sub-fields includes a scan electrode driving circuit that drives the scan electrode, a sustain electrode driving circuit that drives the sustain electrode, and a data electrode driving circuit that drives the data electrodes, wherein at least one sub-field of the plurality of sub-fields includes a first setup period where wall charges of the plurality of discharge cells are adjusted so that write discharges can be performed, the scan electrode driving circuit applies a ramp voltage that changes from a first potential to a second potential to the scan electrode for a setup discharge in the first setup period, the sustain electrode driving circuit applies a voltage that changes from a third potential to a fourth potential to the sustain electrode before a time point where a potential of the scan electrode starts changing to the first potential so that a potential difference between the scan electrode and the sustain electrode is decreased, and the data electrode driving circuit applies to each of the data electrodes a voltage that changes from a fifth potential to a sixth potential before the time point where the potential of the sustain electrode starts changing to the first potential so that a potential difference between the scan electrode and each of the data electrodes is increased in synchronization with change of a voltage of the sustain electrode.

In this plasma display device, the at least one sub-field of the plurality of sub-fields includes the first setup period where the wall charges of the plurality of discharge cells are adjusted so that the write discharges can be performed. In this first setup period, the ramp voltage changing from the first potential to the second potential is applied to the scan electrode by the scan electrode driving circuit.

Meanwhile, the voltage changing from the third potential to the fourth potential is applied to the sustain electrode by the sustain electrode driving circuit so that the potential difference between the scan electrode and the sustain electrode is decreased before the time point where the potential of the scan electrode starts changing to the first potential in the first setup period. In addition, the voltage changing from the fifth potential to the sixth potential is applied to the data electrodes by the data electrode driving circuit before the time point where the potential of the scan electrode starts changing to the first potential in the first setup period so that the potential difference between the sustain electrode and each of the data electrodes is increased in synchronization with the change of the voltage applied to the sustain electrode.

As described above, a potential difference between the sustain electrode and each of the data electrodes is increased before the time point where the potential of the scan electrode starts changing to the first potential, generating the discharge between the sustain electrode and each of the data electrodes. As a result, the wall charges on the sustain electrode and each of the data electrodes are erased or reduced.

In addition, when weak erase discharges are performed at an end of a preceding sustain period for prevention of crosstalk, a large amount of wall charges is stored on the sustain electrode before the start of the first setup period. Since the wall charges are erased or reduced by the discharge between the sustain electrode and each of the data electrodes even in such a case, generation of strong discharges between the scan electrode and the sustain electrode is prevented at the time point where the potential of the scan electrode starts changing to the first potential. In this case, the wall charges remain on the scan electrode and the sustain electrode.

After that, the voltage between the scan electrode and the sustain electrode can be reliably made higher than a discharge start voltage during a period where the ramp voltage applied to the scan electrode changes from the first potential to the second potential as described above. This generates weak setup discharges between the scan electrode and the sustain electrode. As a result, the wall charges of the plurality of discharge cells can be reliably adjusted to an amount required for the write discharges.

The voltage of each of the data electrodes attains the sixth potential so that the potential difference between the scan electrode and each of the data electrodes is reduced, thus preventing generation of strong discharges between the scan electrode and each of the data electrodes and generation of the strong discharges between the scan electrode and the sustain electrode.

As a result, the wall charges on the scan electrode, the sustain electrode and each of the data electrodes are not erased by the strong discharges, and the wall charges of the plurality of discharge cells can be adjusted to a value suitable for the write discharges.

(2) The data electrode driving circuit may cause a voltage of each of the data electrodes to change from the sixth potential to the fifth potential before the time point where the potential of the scan electrode starts changing to the first potential, and subsequently cause the voltage of each of the data electrodes to return to the sixth potential after the time point where the potential of the scan electrode starts changing to the first potential.

In this case, an occurrence of ripples in the voltage of each of the data electrodes at the time of the change of the ramp voltage is prevented. Thus, components with a low breakdown voltage can be used in the data electrode driving circuit.

(3) The data electrode driving circuit may maintain a voltage of each of the data electrodes at the sixth potential during application of the ramp voltage. In this case, the voltage applied to each of the data electrodes is easily controlled.

(4) The second potential may be a positive potential that is higher than the first potential, the third potential may be a positive potential that is higher than the fourth potential, and the sixth potential may be a positive potential that is higher than the fifth potential.

In this case, the ramp voltage applied to the scan electrode rises from the first potential to the second potential. In addition, the voltage applied to the sustain electrode drops from the third potential to the fourth potential before the time point where the potential of the scan electrode starts changing to the first potential. Furthermore, the voltage applied to each of the data electrodes rises from the fifth potential to the sixth potential before the time point where the potential of the scan electrode starts changing to the first potential. In this manner, the positive voltages are applied to the scan electrode, the sustain electrode and each data electrode, thus preventing a complicated configuration of a power supply circuit.

(5) The fourth potential and the sixth potential may be set so that a first discharge is generated between the sustain electrode and each of the data electrodes, the ramp voltage may be set so that a second discharge is generated between the scan electrode and the sustain electrode during change of the ramp voltage from the first potential to the second potential after the first discharge, and a discharge current in the second discharge may be smaller than a discharge current in the first discharge.

In this case, since the discharge current in the second discharge is smaller than the discharge current in the first discharge, the wall charges stored on the scan electrode and the wall charges stored on the sustain electrode are adjusted to appropriate amounts without being erased.

(6) The scan electrode driving circuit may apply a pulse voltage having a seventh potential to the scan electrode at an end of a sustain period preceding the first setup period, and the sustain electrode driving circuit may apply a voltage that changes from the fourth potential to the third potential to the sustain electrode during a period of application of the pulse voltage in order to decrease wall charges of a discharge cell in which a sustain discharge has been performed.

In this case, the weak erase discharges can cause the large amount of wall charges to remain on the scan electrode and sustain electrode at the end of the sustain period preceding the first setup period. Accordingly, the write discharges are weakened in the write period after the first setup period to prevent the crosstalk from occurring between adjacent discharge cells.

(7) The scan electrode driving circuit may apply a first ramp pulse voltage having a seventh potential to the scan electrode at an end of a sustain period preceding the first setup period in order to decrease wall charges of a discharge cell in which a sustain discharge has been performed, a leading edge of the first ramp pulse voltage may change more gradually than a trailing edge, and the sustain electrode driving circuit may cause the sustain electrode to be held at the fourth potential during a period of application of the first ramp pulse voltage.

In this case, since the leading edge of the first ramp pulse voltage gradually changes, the weak erase discharges can cause the large amount of wall charges to remain on the scan electrode and the sustain electrode at the end of the sustain period preceding the first setup period. Accordingly, the write discharges are weakened in the write period after the first setup period to prevent the crosstalk from occurring between the adjacent discharge cells.

(8) The sub-field including the first setup period may be a first sub-field in the one field period, a sub-field not including the first setup period may include a second setup period where the wall charges of the discharge cell, which has been subjected to the sustain discharge, of the plurality of discharge cells are adjusted so that the write discharge can be performed, and the scan electrode driving circuit may apply a second ramp pulse voltage having an eighth potential to the scan electrode for decreasing the wall charges of the discharge cell that has been subjected to the sustain discharge at the end of the sustain period preceding the second setup period, a leading edge of the second ramp pulse voltage may change more gradually than a trailing edge, the sustain electrode driving circuit may cause the sustain electrode to be held at the fourth potential during a period of application of the second ramp pulse voltage, and the seventh potential may be higher than the eighth potential.

In this case, since the leading edge of the second ramp pulse voltage applied to the scan electrode gradually changes at the end of the sustain period preceding the second setup period. Thus, the weak erase discharges can cause the large amount of wall charges to remain on the scan electrode and the sustain electrode. Accordingly, the write discharges are weakened in the write period after the second setup period to prevent the crosstalk from occurring between the adjacent discharge cells.

In addition, the first setup period is included in the first sub-field of the one field period. Thus, the first ramp pulse voltage is applied to the scan electrode at the end of the sustain period of the last sub-field of the one field period.

Here, the seventh potential of the first ramp pulse voltage is higher than the eighth potential of the second ramp pulse voltage. Accordingly, the wall charges stored on the sustain electrode can be reliably reduced by a predetermined amount even though a weight amount of the sub-field, in which the last lighting is performed, in the one field period is small. As a result, the stable setup discharges can be performed and low gray levels can be clearly displayed.

(9) According to another aspect of the present invention, a method of driving a plasma display device that drives a plasma display panel including a plurality of discharge cells at intersections of a scan electrode and a sustain electrode with a plurality of data electrodes by a sub-field method in which one field period includes a plurality of sub-fields includes the steps of driving the scan electrode, driving the sustain electrode, and driving the data electrodes, wherein at least one sub-field of the plurality of sub-fields may include a setup period where wall charges of the plurality of discharge cells are adjusted so that write discharges can be performed, the step of driving the scan electrode may include applying a ramp voltage that changes from a first potential to a second potential to the scan electrode for setup discharges in the setup period, the step of driving the sustain electrode may include applying a voltage that changes from a third potential to a fourth potential to the sustain electrode so that a potential difference between the scan electrode and the sustain electrode is decreased before a time point where a potential of the scan electrode starts changing to the first potential, and the step of driving the data electrodes may include applying a voltage that changes from a fifth potential to a sixth potential to each of the data electrodes so that a potential difference between the sustain electrode and each of the data electrodes is increased in synchronization with change of a voltage of the sustain electrode before the time point where the potential of the scan electrode starts changing to the first potential.

In this method of driving the plasma display device, the at least one sub-field of the plurality of sub-fields includes the setup period where the wall charges of the plurality of discharge cells are adjusted so that the write discharges can be performed. In this setup period, the ramp voltage changing from the first potential to the second potential is applied to the scan electrode.

Meanwhile, the voltage changing from the third potential to the fourth potential is applied to the sustain electrode so that the potential difference between the scan electrode and the sustain electrode is decreased before the time point where the potential of the scan electrode starts changing to the first potential in the setup period. In addition, the voltage changing from the fifth potential to the sixth potential is applied to the data electrodes before the time point where the potential of the scan electrode starts changing to the first potential in the setup period so that the potential difference between the sustain electrode and each of the data electrodes is increased in synchronization with the change of the voltage applied to the sustain electrode.

As described above, a potential difference between the sustain electrode and each of the data electrodes is increased before the time point where the potential of the scan electrode starts changing to the first potential, generating the discharge between the sustain electrode and each of the data electrodes. As a result, the wall charges on the sustain electrode and each of the data electrodes are erased or reduced.

In addition, when weak erase discharges are performed at an end of a preceding sustain period for prevention of crosstalk, a large amount of wall charges is stored on the sustain electrode before the start of the setup period. Since the wall charges are erased or reduced by the discharges between the sustain electrode and each of the data electrodes even in such a case, generation of strong discharges between the scan electrode and the sustain electrode is prevented at the time point where the potential of the scan electrode starts changing to the first potential. In this case, the wall charges remain on the scan electrode and the sustain electrode.

After that, the voltage between the scan electrode and the sustain electrode can be reliably made higher than a discharge start voltage during a period where the ramp voltage applied to the scan electrode changes from the first potential to the second potential as described above. This generates weak setup discharges between the scan electrode and the sustain electrode. As a result, the wall charges of the plurality of discharge cells can be reliably adjusted to an amount required for the write discharges.

The voltage of each of the data electrodes attains the sixth potential so that the potential difference between the scan electrode and each of the data electrodes is reduced, thus preventing generation of strong discharges between the scan electrode and each of the data electrodes and generation of the strong discharges between the scan electrode and the sustain electrode.

As a result, the wall charges on the scan electrode, the sustain electrode and each of the data electrodes are not erased by the strong discharges, and the wall charges of the plurality of discharge cells can be adjusted to a value suitable for the write discharges.

Effects of the Invention

According to the present invention, crosstalk is prevented from occurring between adjacent discharge cells, and desired amounts of wall charges can be formed on a plurality of electrodes constituting discharge cells.

BEST MODE FOR CARRYING OUT THE INVENTION

Figure 1:
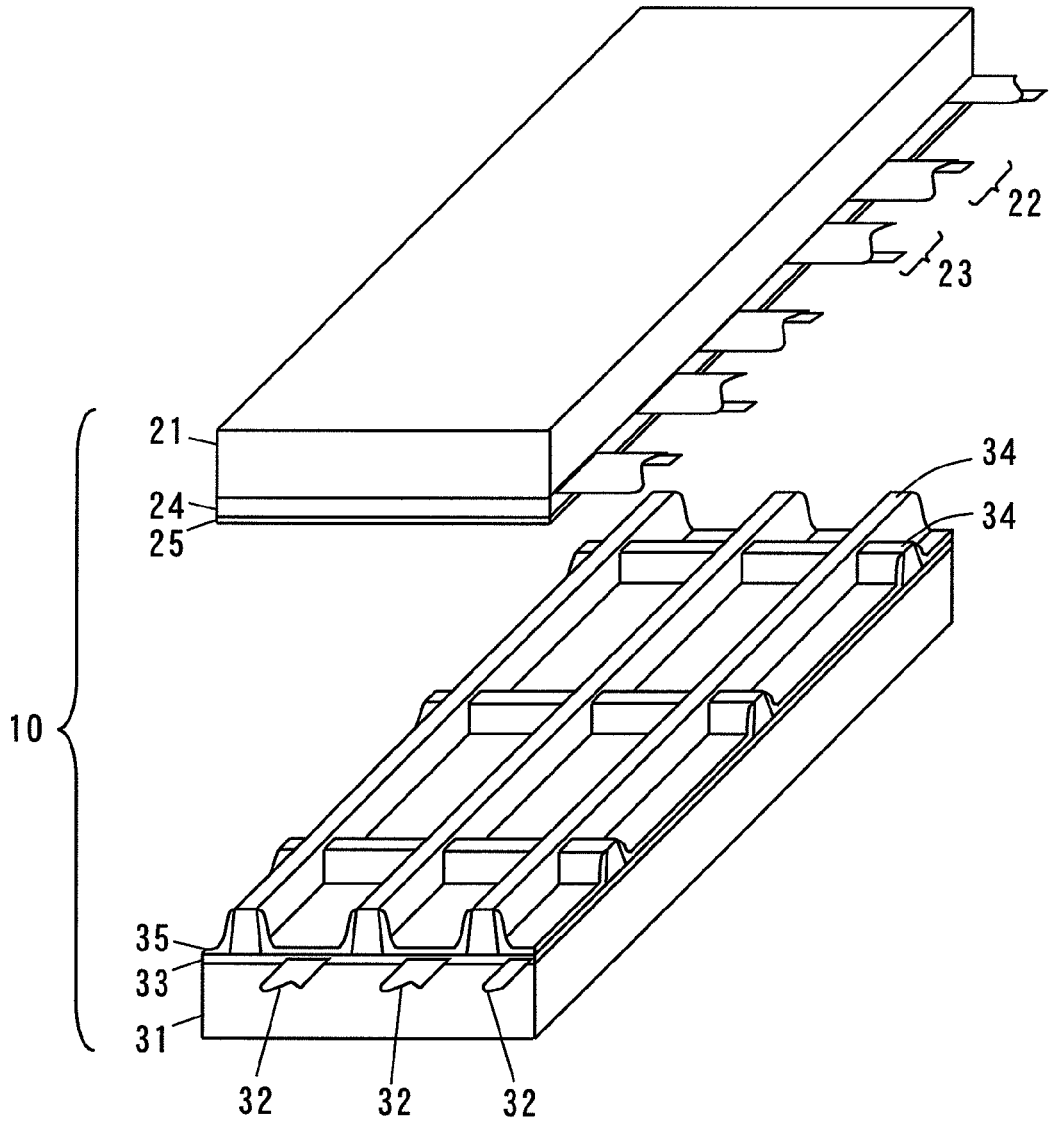
FIG. 1 is an exploded perspective view showing part of a plasma display panel in a plasma display device according to one embodiment of the present invention.

The embodiments of the present invention will be described in detail referring to the drawings. The embodiments below describe a plasma display device and a method of driving the same.

(1) Configuration of Panel

FIG. 1 is an exploded perspective view showing part of a plasma display panel in a plasma display device according to one embodiment of the present invention.

The plasma display panel (hereinafter abbreviated as the panel) 10 includes a front substrate 21 and a back substrate 31 that are made of glasses and arranged so as to face each other. A discharge space is formed between the front substrate 21 and the back substrate 31. A plurality of pairs of scan electrodes 22 and sustain electrodes 23 are formed in parallel with one another on the front substrate 21. Each pair of scan electrode 22 and sustain electrode 23 constitutes a display electrode. A dielectric layer 24 is formed so as to cover the scan electrodes 22 and the sustain electrodes 23, and a protective layer 25 is formed on the dielectric layer 24.

A plurality of data electrodes 32 covered with an insulator layer 33 are provided on the back substrate 31, and barrier ribs 34 are provided in a shape of a number sign on the insulator layer 33. Phosphor layers 35 are provided on a surface of the insulator layer 33 and side surfaces of the barrier ribs 34. Then, the front substrate 21 and the back substrate 31 are arranged to face each other such that the plurality of pairs of scan electrodes 22 and sustain electrodes 23 vertically intersect with the plurality of data electrodes 32, and the discharge space is formed between the front substrate 21 and the back substrate 31. The discharge space is filled with a mixed gas of neon and xenon, for example, as a discharge gas. Note that the configuration of the panel is not limited to the configuration described in the foregoing. A configuration including the barrier ribs in a striped shape may be employed, for example.

Figure 2:
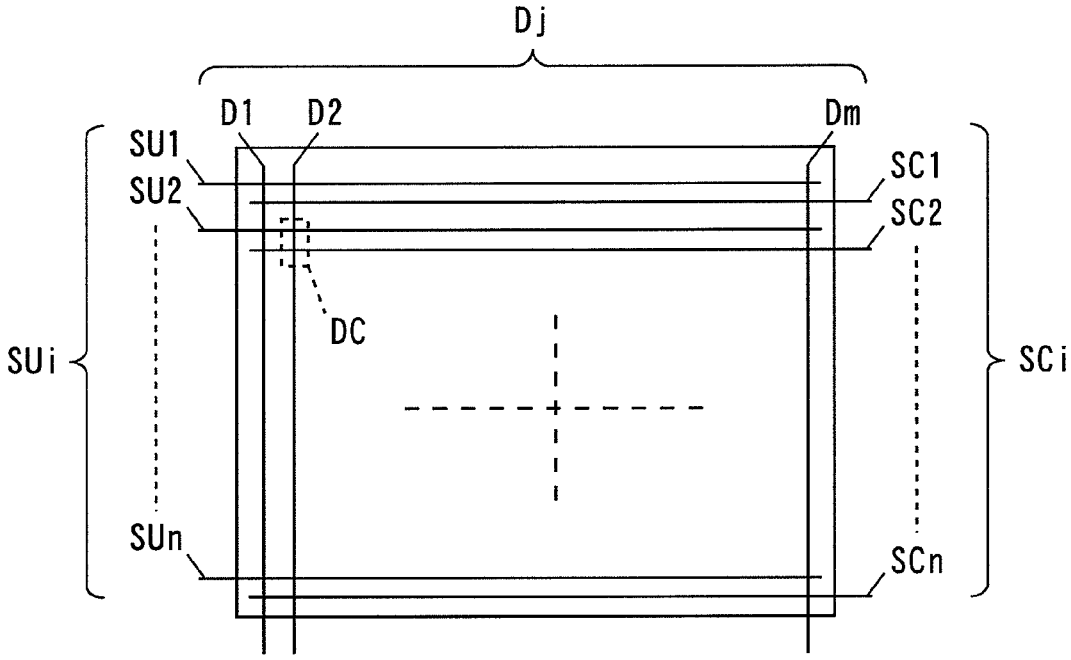
FIG. 2 is a diagram showing an arrangement of electrodes of the panel in the one embodiment of the present invention.

FIG. 2 is a diagram showing an arrangement of the electrodes of the panel in the one embodiment of the present invention. N scan electrodes SC1 to SCn (the scan electrodes 22 of FIG. 1) and n sustain electrodes SU1 to SUn (the sustain electrodes 23 of FIG. 1) are arranged along a row direction, and m data electrodes D1 to Dm (the data electrodes 32 of FIG. 1) are arranged along a column direction. Each of n and m is a natural number of not less than two. Then, a discharge cell DC is formed at an intersection of a pair of scan electrode SCi (i=1 to n) and sustain electrode SUi (i=1 to n) with one data electrode Dj (j=1 to m). Accordingly, m×n discharge cells are formed in the discharge space.

(2) Configuration of the Plasma Display Device

Figure 3:
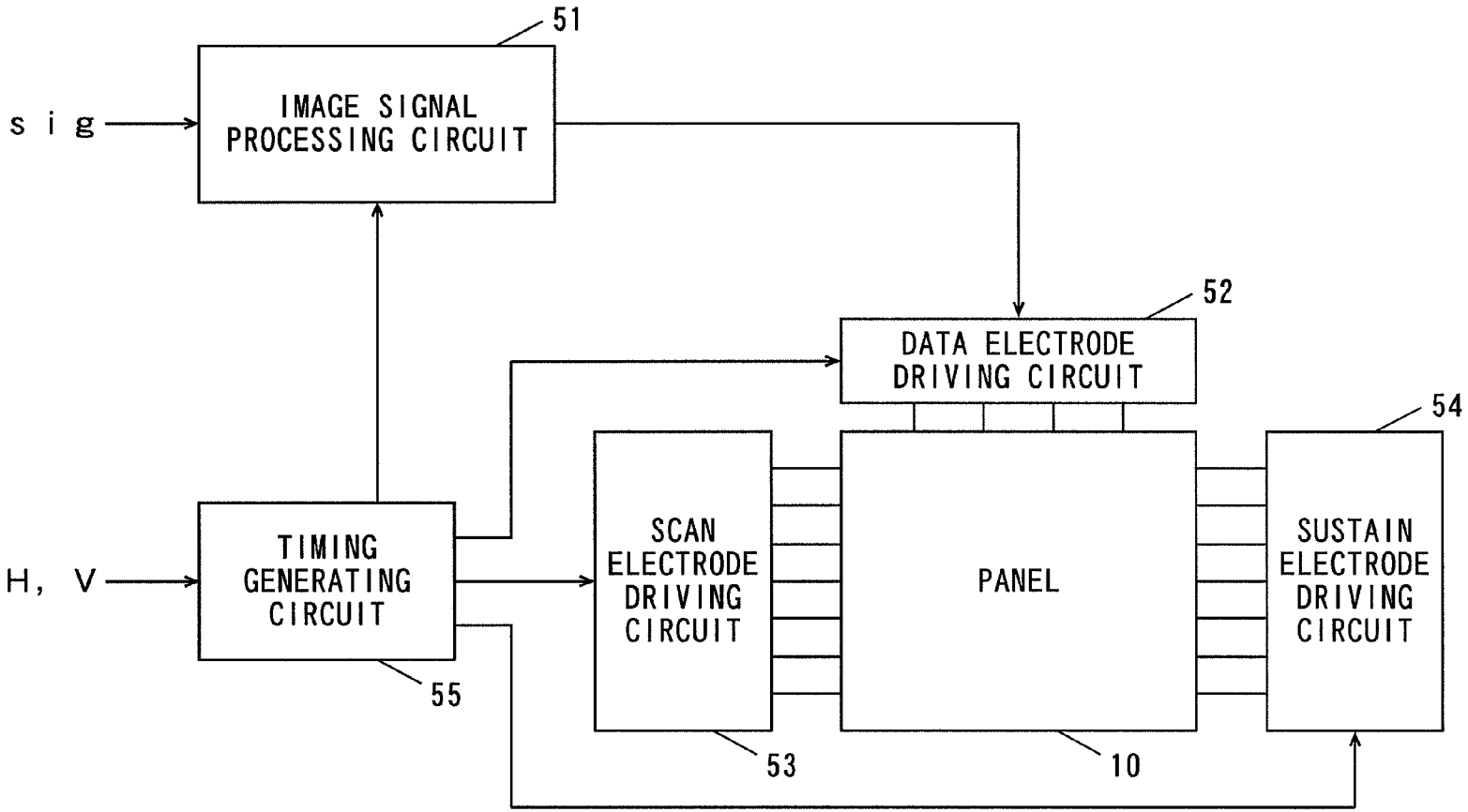
FIG. 3 is a block diagram of circuits in the plasma display device according to the one embodiment of the present invention.

FIG. 3 is a block diagram of circuits in the plasma display device according to the one embodiment of the present invention.

This plasma display device includes the panel 10, an image signal processing circuit 51, a data electrode driving circuit 52, a scan electrode driving circuit 53, a sustain electrode driving circuit 54, a timing generating circuit 55 and a power supply circuit (not shown).

The image signal processing circuit 51 converts an image signal sig into image data corresponding to the number of pixels of the panel 10, divides the image data on each pixel into a plurality of bits corresponding to a plurality of sub-fields, and outputs them to the data electrode driving circuit 52.

The data electrode driving circuit 52 converts the image data for each sub-field into signals corresponding to the data electrodes D1 to Dm, respectively, and drives the data electrodes D1 to Dm based on the respective signals.

The timing generating circuit 55 generates timing signals based on a horizontal synchronizing signal H and a vertical synchronizing signal V, and supplies the timing signals to each of the driving circuit blocks (the image signal processing circuit 51, the data electrode driving circuit 52, the scan electrode driving circuit 53 and the sustain electrode driving circuit 54).

The scan electrode driving circuit 53 supplies driving waveforms to the scan electrodes SC1 to SCn based on the timing signals, and the sustain electrode driving circuit 54 supplies driving waveforms to the sustain electrodes SU1 to SUn based on the timing signals.

(3) Method of Driving the Panel

Figure 4:
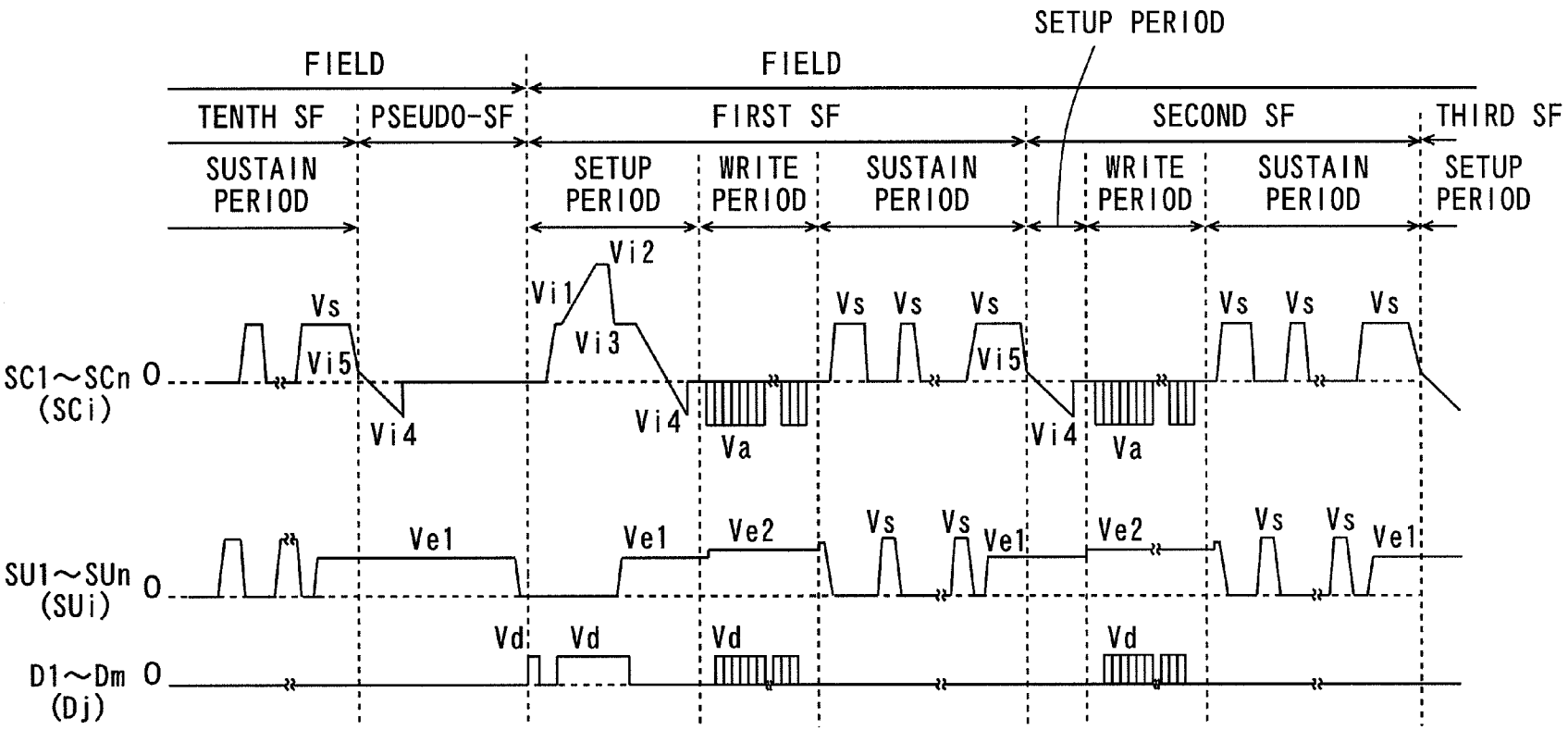
FIG. 4 is a diagram showing examples of driving waveforms applied to respective electrodes of the plasma display device according to the one embodiment of the present invention.
Figure 5:
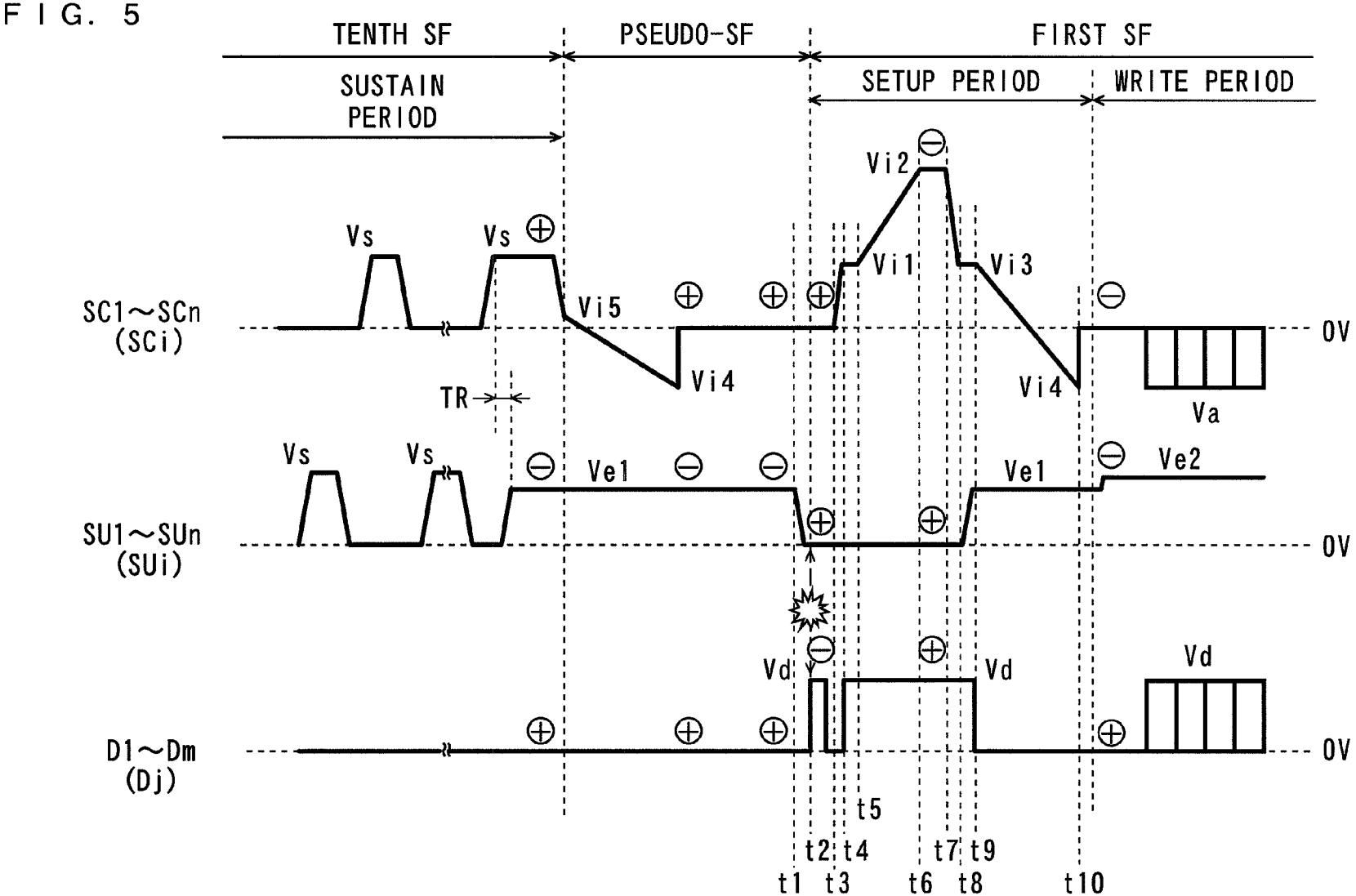
FIG. 5 is a partially enlarged view of the driving waveforms of FIG. 4.

A method of driving the panel in the present embodiment will be described. FIG. 4 is a diagram showing examples of the driving waveforms applied to the respective electrodes in the plasma display device according to the one embodiment of the present invention. FIG. 5 is a partially enlarged view of the driving waveforms of FIG. 4.

FIGS. 4 and 5 show the driving waveform applied to one scan electrode of the scan electrodes SC1 to SCn, the driving waveform applied to one sustain electrode of the sustain electrodes SU1 to SUn, and the driving waveform applied to one data electrode of the data electrodes D1 to Dm.

In the present embodiment, each field is divided into a plurality of sub-fields. In the present embodiment, one field is divided into ten sub-fields (hereinafter abbreviated as a first SF, a second SF, . . . and a tenth SF) on a time base. In addition, a pseudo-sub-field (hereinafter abbreviated as a pseudo-SF) is provided in a period sandwiched between the tenth SF of each field and the next field.

FIG. 4 shows periods from a sustain period of the tenth SF of a field preceding one field to a setup period of the third SF of the one field. FIG. 5 shows periods from the sustain period of the tenth SF to a write period of the first SF of the next field of FIG. 4.

In the following description, a voltage caused by wall charges stored on the dielectric layer, the phosphor layer or the like covering the electrode is referred to as a wall voltage on the electrode.

As shown in FIGS. 4 and 5, the voltage of the sustain electrode SUi is raised to Ve1 after a predetermined period of time (a phase difference TR) has elapsed since the last rise of the voltage of the scan electrode SCi to Vs in the tenth SF of the preceding field. Accordingly, an erase discharge is induced between the scan electrode SCi and the sustain electrode SUi, and positive wall charges stored on the scan electrode SCi and negative wall charges stored on the sustain electrode SUi are decreased. In the present embodiment, the phase difference TR is set small so that the erase discharge is weakened. In general, the above-described phase difference TR for the erase discharge is about 450 nsec. In contrast, the phase difference TR is set to, for example, 150 nsec in this example.

As described above, the phase difference TR is set small, so that the erase discharge between the scan electrode SCi and the sustain electrode SUi is weakened. This causes a large amount of positive wall charges to remain on the scan electrode SCi, and causes a large amount of negative wall charges to remain on the sustain electrode SUi. At this time, positive wall charges are stored on the data electrode Dj.

The sustain electrode SUi is held at the voltage Ve1, the data electrode Dj is held at a ground potential (a reference voltage), and a ramp voltage is applied to the scan electrode SCi in the first half of the pseudo-SF. This ramp voltage gradually drops from a positive voltage Vi5 that is slightly higher than the ground potential toward a negative voltage Vi4 that is not more than a discharge start voltage.

Thus, weak discharges are generated between the scan electrode SCi and the data electrode Dj and between the scan electrode SCi and the sustain electrode SUi. As a result, the positive wall charges on the scan electrode SCi slightly increases, and the negative wall charges on the sustain electrode SUi slightly increases. The positive wall charges are stored on the data electrode Dj. In this manner, the wall charges on all the discharge cells DC are substantially uniformly adjusted.

In the second half of the pseudo-SF, the scan electrode SCi is held at the ground potential.

In this manner, a great amount of positive wall charges is stored on the scan electrode SCi and a great amount of negative wall charges is stored on the sustain electrode SUi at the end of the pseudo-SF.

Then, the voltage of the sustain electrode SUi is lowered from Ve1 to the ground potential at a time point t1 immediately before the first SF of the next field, as shown in FIG. 5. Then, a pulsed positive voltage Vd is applied to the data electrode Dj at a starting time point t2 of the setup period of the first SF.

A great amount of negative wall charges is stored on the sustain electrode SUi and the positive wall charges are stored on the data electrode Dj immediately before the time point t2. When the voltage of the data electrode Dj rises to Vd, the voltage between the sustain electrode SUi and the data electrode Dj attains a value obtained by adding the wall voltage on the data electrode Dj and the wall voltage on the sustain electrode SUi to the voltage Vd. This causes the voltage between the sustain electrode SUi and the data electrode Dj to exceed the discharge start voltage, resulting in generation of a strong discharge between the sustain electrode SUi and the data electrode Dj.

This strong discharge causes the negative wall charges on the sustain electrode SUi to be erased and zero or a small amount of positive wall charges to be stored on the sustain electrode SUi. Moreover, the wall charges on the data electrode Dj is erased and zero or a small amount of negative wall charges is stored on the data electrode Dj. At this time, the positive wall charges on the scan electrode SCi are also slightly erased.

After that, the voltage of the scan electrode SCi is raised at a time point t3, and the scan electrode SCi is held at a positive voltage Vi1 at a time point t4. In addition, the voltage of the data electrode Dj is raised to Vd at the time point t4. At this time, since zero or the small amount of positive wall voltage is stored on the sustain electrode SUi, the strong discharge is not generated between the scan electrode SCi and the sustain electrode SUi.

At the time point t4, a ramp voltage is applied to the scan electrode SCi. This ramp voltage gradually rises from the positive voltage Vi1 that is not more than the discharge start voltage toward a positive voltage Vi2 that exceeds the discharge start voltage in a period from a time point t5 to a time point t6. Here, since the data electrode Dj is held at the voltage Vd, generation of the strong discharge between the scan electrode SCi and the data electrode Dj is prevented. The sustain electrode SUi is held at the ground potential.

When the voltage between the scan electrode SCi and the sustain electrode SUi exceeds the discharge start voltage with the rise of the ramp voltage, weak setup discharges are induced between the scan electrode SCi and the sustain electrode SUi in all the discharge cells DC.

Accordingly, the positive wall charges stored on the scan electrode SCi are gradually erased, and the negative wall charges are stored on the scan electrode SCi. Meanwhile, the positive wall charges are stored on the sustain electrode SUi.

The voltage of the scan electrode SCi is lowered at a time point t7, and is held at a voltage Vi3 at a time point t8. At this time, the positive voltage Ve1 is applied to the sustain electrode SUi.

A negative ramp voltage is applied to the scan electrode SCi at a time point t9. This ramp voltage drops from the positive voltage Vi3 to a negative voltage Vi4 in a period from the time point t9 to a time point t10. In addition, the voltage of the data electrode Dj is lowered and held at the ground potential at the time point t9.

The voltage of the sustain electrode SUi is held at the positive voltage Ve1 in the period from the time point t9 to the time point t10. When the voltage between the scan electrode SCi and the sustain electrode SUi exceeds the discharge start voltage with the drop of the ramp voltage, the weak setup discharges are induced in all the discharge cells DC.

Thus, the negative wall charges stored on the scan electrode SCi are gradually erased in the period from the time point t9 to the time point t10, and a small amount of negative wall charges remains on the scan electrode SCi at the time point t10. Meanwhile, the positive wall charges stored on the sustain electrode SUi are gradually erased in the period from the time point t9 to the time point t10, and the negative wall charges are stored on the sustain electrode SUi at the time point t10. Furthermore, the positive wall charges are stored on the data electrode Dj in the period from the time point t9 to the time point t10.

The voltage of the scan electrode SCi is raised to the ground potential at the time point t10. Thus, the setup period is finished, and the wall voltage on the scan electrode SCi, the wall voltage on the sustain electrode SUi and the wall voltage on the data electrode Dj are adjusted to respective values suitable for a write operation. Specifically, the small amount of negative wall charges is stored on the scan electrode SCi, the negative wall charges are stored on the sustain electrode SUi, and the positive wall charges are stored on the data electrode Dj.

As described above, a setup operation for all the cells in which the setup discharges are generated in all the discharge cells DC is performed in the setup period of the first SF.

Returning to FIG. 4, a voltage Ve2 is applied to the sustain electrode SUi and the voltage of the scan electrode SCi is held at the ground potential in the write period of the first SF. Next, a write pulse having the positive voltage Vd is applied to a data electrode Dk (k is any of 1 to m), among the data electrodes Dj, of the discharge cell that should emit light on a first row while a scan pulse having a negative voltage Va is applied to the scan electrode SC1 on the first row.

Then, a voltage at an intersection of the data electrode Dk and the scan electrode SC1 attains a value obtained by adding the wall voltage on the data electrode Dk and the wall voltage on the scan electrode SC1 to an externally applied voltage (Vd−Va), exceeding the discharge start voltage. This generates write discharges between the data electrode Dk and the scan electrode SC1 and between the sustain electrode SU1 and the scan electrode SC1.

As described above, the negative wall charges are stored on the scan electrode SCi and the sustain electrode SUi and the positive wall charges are stored on the data electrode Dj when the write period is started in the present embodiment. Therefore, the write discharge between the sustain electrode SU1 and the scan electrode SC1 is weakened.

Accordingly, an occurrence of crosstalk between the adjacent discharge cells DC is prevented even when distances between the adjacent discharge cells are set small in the panel of FIG. 1.

The foregoing write discharge causes the positive wall charges to be stored on the scan electrode SC1, the negative wall charges to be stored on the sustain electrode SU1 and the negative wall charges to be stored on the data electrode Dk in the discharge cell DC.

In this manner, the write operation in which the write discharge is generated in the discharge cell DC that should emit light on the first row to cause the wall charges to be stored on each electrode is performed. Meanwhile, since a voltage of a discharge cell DC at an intersection of a data electrode Dh (h≠k) to which the write pulse has not been applied and the scan electrode SC1 does not exceed the discharge start voltage, the write discharge is not generated.

The above-described write operation is sequentially performed in the discharge cells DC on the first row to the n-th row, and the write period is then finished.

In a subsequent sustain period, the sustain electrode SUi is returned to the ground potential, and a sustain pulse voltage Vs having the voltage Vs is applied to the scan electrode SCi. At this time, the voltage between the scan electrode SCi and the sustain electrode SUi attains a value obtained by adding the wall voltage on the scan electrode SCi and the wall voltage on the sustain electrode SUi to the voltage Vs of the sustain pulse, exceeding the discharge start voltage in the discharge cell DC in which the write discharge has been generated in the write period.

This induces a sustain discharge between the scan electrode SCi and the sustain electrode SUi, causing the discharge cell DC to emit light. As a result, the negative wall charges are stored on the scan electrode SCi, the positive wall charges are stored on the sustain electrode SUi, and the positive wall charges are stored on the data electrode Dk. In the discharge cell DC in which the write discharge has not been generated in the write period, the sustain discharge is not induced and the wall charges are held in a state at the end of the setup period.

Then, the scan electrode SCi is returned to the ground potential, and the sustain pulse having the voltage Vs is applied to the sustain electrode SUi. Since the voltage between the sustain electrode SUi and the scan electrode SCi exceeds the discharge start voltage in the discharge cell DC in which the sustain discharge has been induced, the sustain discharge is again induced between the sustain electrode SUi and the scan electrode SCi, causing the negative wall charges to be stored on the sustain electrode SUi and the positive wall charges to be stored on the scan electrode SCi.

Similarly to this, a predetermined number of sustain pulses are alternately applied to the scan electrode SCi and the sustain electrode SUi, so that the sustain discharges are continuously performed in the discharge cell DC in which the write discharge has been generated in the write period.

Before the sustain period is finished, the voltage applied to the sustain electrode SUi is raised to Ve1 after the predetermined period of time (the phase difference TR) since the voltage applied to the scan electrode SCi has been raised to Vs. This induces a weak erase discharge between the scan electrode SCi and the sustain electrode SUi, similarly to the case at the end of the tenth SF described referring to FIG. 5.

In a setup period of the second SF, the voltage of the sustain electrode SUi is held at Ve1, the data electrode Dj is held at the ground potential, and a ramp voltage gradually dropping from the positive voltage Vi5 toward the negative voltage Vi4 is applied to the scan electrode SCi, similarly to the pseudo-SF described referring to FIG. 5. Then, the weak setup discharge is generated in the discharge cell DC in which the sustain discharge has been induced in the sustain period of the preceding sub-field.

This weakens the wall voltage on the scan electrode SCi and the wall voltage on the sustain electrode SUi, and the wall voltage on the data electrode Dk is adjusted to a value suitable for the write operation.

Meanwhile, the discharge is not generated and the wall charges are kept constant in the state at the end of the setup period of the preceding sub-field in the discharge cell DC in which the write discharge and the sustain discharge have not been induced in the preceding sub-field.

As described above, a selective setup operation in which the setup discharges are selectively generated in the discharge cells DC in which the sustain discharges have been induced in the immediately preceding sub-field is performed in the setup period of the second SF.

In a write period of the second SF, the write operation is sequentially performed in the discharge cells on the first row to the n-th row similarly to the write period of the first SF, and the write period is then finished. Since an operation in the subsequent sustain period is the same as that in the sustain period of the first SF except for the number of the sustain pulses, explanation is omitted.

In setup periods of the subsequent third to tenth SFs, the selective setup operations are performed similarly to the setup period of the second SF. In write periods of the third to tenth SFs, the voltage Ve2 is applied to the sustain electrode SUi similarly to the second SF to perform the write operations. In sustain periods of the third to tenth SFs, the same sustain operations as that in the sustain period of the first SF except for the number of the sustain pulses are performed.

Figure 6:
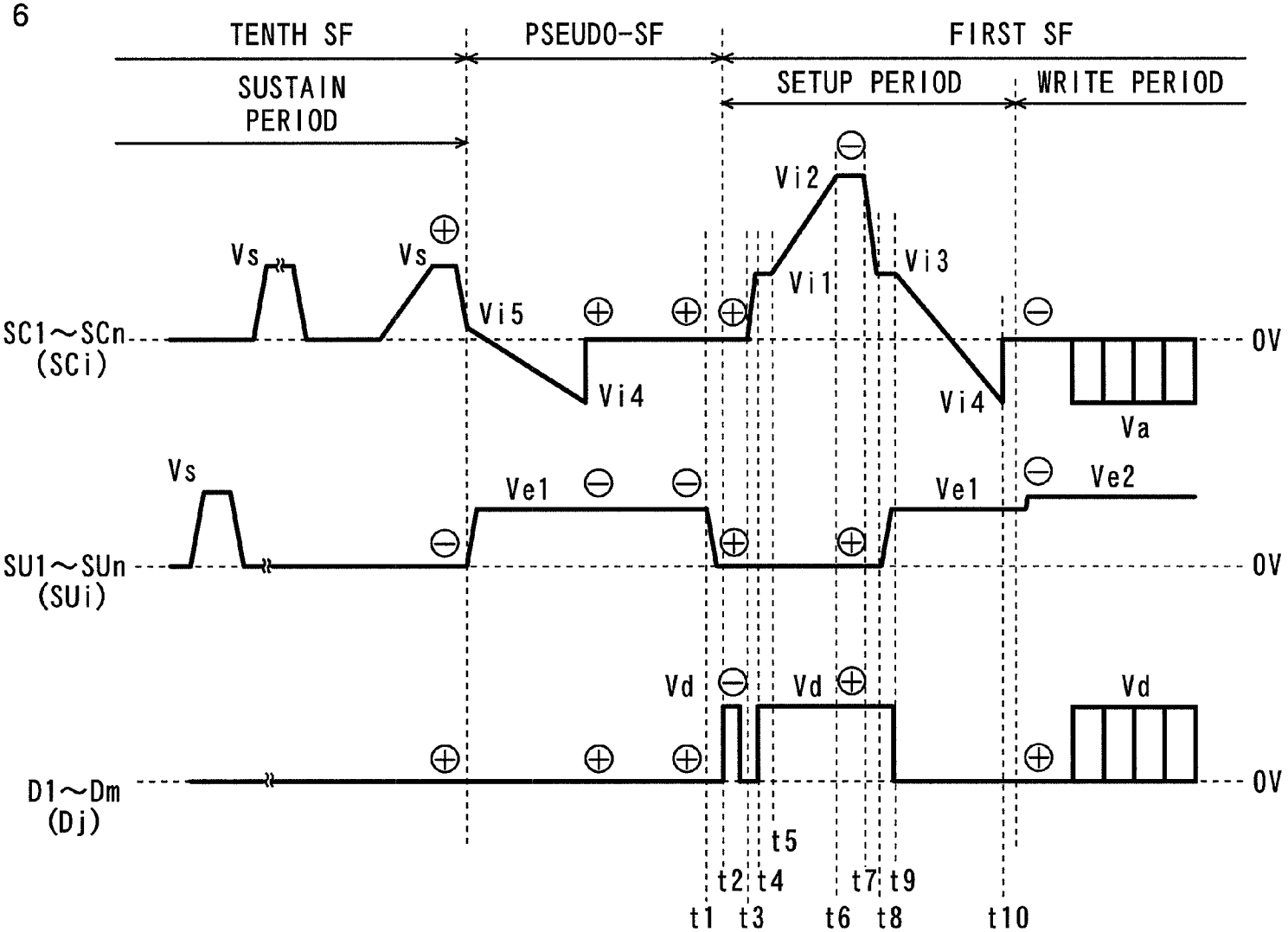
FIG. 6 is an enlarged view showing other examples of the driving waveforms applied to the respective electrodes of the plasma display device according to the one embodiment of the present invention.

(4) Other Examples of the Driving Waveforms (4-a) Adjustment of the Wall Charges The wall charges on the scan electrode SCi and the sustain electrode SUi may be adjusted before the start of the pseudo-SF by applying driving waveforms described below to the respective electrodes. FIG. 6 is an enlarged view showing other examples of the driving waveforms applied to the respective electrodes of the plasma display device according to the one embodiment of the present invention.

In this example, the ramp voltage whose leading edge of the voltage waveform changes more gradually than its trailing edge is applied to the scan electrode SCi at the end of the tenth SF of the preceding field while the sustain electrode SUi and the data electrode Dj are held at the ground potential in order to perform the weak erase discharge before the selective setup as shown in FIG. 6. This ramp voltage gradually rises from the ground potential toward the positive voltage Vs.

Here, the positive wall charges are stored on the scan electrode SCi and the negative wall charges are stored on the sustain electrode SUi in the discharge cell DC in which the sustain discharge has been induced. Thus, as described above, when the ramp voltage is applied to the scan electrode SCi, the voltage between the scan electrode SCi and the sustain electrode SUi exceeds the discharge start voltage in the discharge cell DC in which the sustain discharge has been induced, thus again generating the weak erase discharge between the sustain electrode SUi and the scan electrode SCi.

As a result, the positive wall charges stored on the scan electrode SCi and the negative wall charges stored on the sustain electrode SUi are slightly reduced, a large amount of positive wall charges remains on the scan electrode SCi, and a large amount of negative wall charges remains on the sustain electrode SUi. At this time, the positive wall charges are stored on the data electrode Dj.

Thus, similarly to the example of FIGS. 4 and 5, the selective setup operation is performed in the subsequent pseudo-SF, and the setup operation for all the cells is performed in the setup period of the first SF in the following field, so that the wall voltage on the scan electrode SCi, the wall voltage on the sustain electrode SUi and the wall voltage on the data electrode Dj are adjusted to the respective values suitable for the write operation.

(5) Still Other Examples of the Driving Waveforms (5-a) Adjustment of the Wall Charges The wall charges on the scan electrode SCi and the sustain electrode SUi may be adjusted before the start of the pseudo-SF by applying driving waveforms described below to the respective electrodes.

Figure 7:
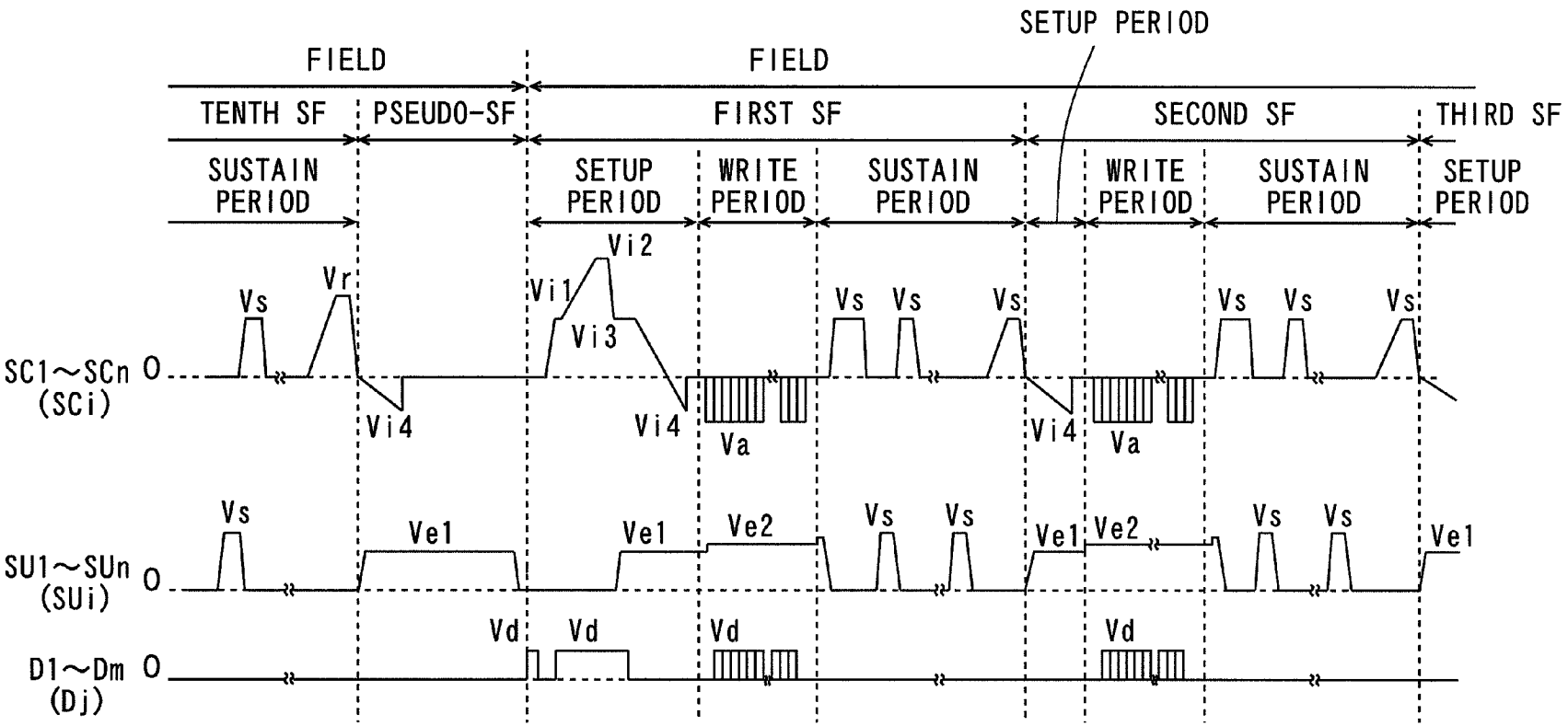
FIG. 7 is a diagram showing still other examples of the driving waveforms applied to the respective electrodes of the plasma display device according to the one embodiment of the present invention.
Figure 8:
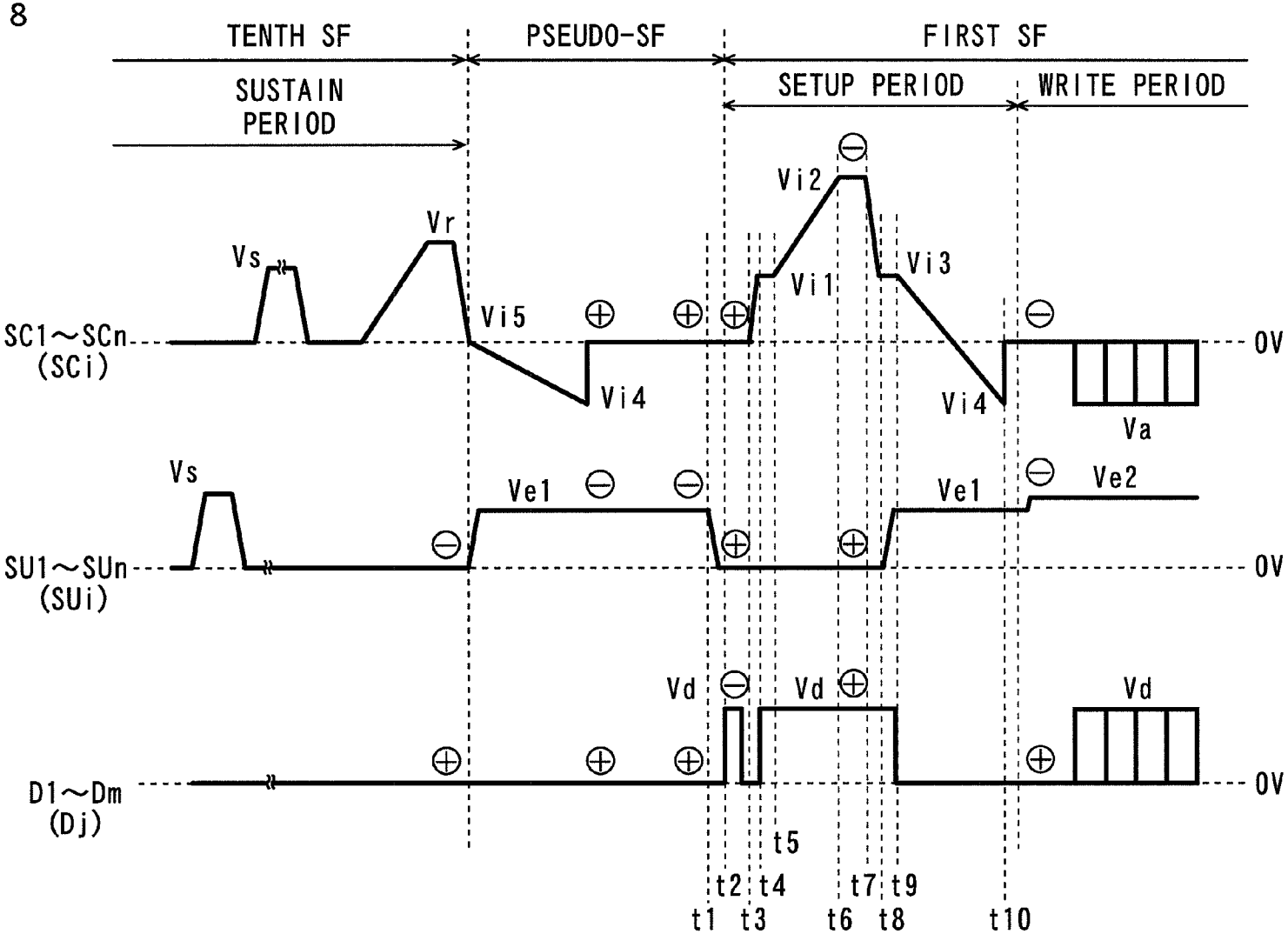
FIG. 8 is a partially enlarged view of the driving waveforms of FIG. 7.

FIG. 7 is a diagram showing still other examples of the driving waveforms applied to the respective electrodes of the plasma display device according to the one embodiment of the present invention. FIG. 8 is a partially enlarged view of the driving waveforms of FIG. 7.

The tenth SF in one field is referred to as the last SF in the description below of FIGS. 7 and 8.

The driving waveforms shown in FIGS. 7 and 8 are described while referring to differences from the driving waveforms shown in FIGS. 4 and 5. As shown in FIGS. 7 and 8, in this example, a first ramp voltage whose leading edge of the voltage waveform changes more gradually than its trailing edge is applied to the scan electrode SCi in the tenth SF of the preceding field, that is, at the end of the last SF while the sustain electrode SUi and the data electrode Dj are held at the ground potential. The first ramp voltage is used for generating the weak erase discharge between the sustain electrode SUi and the scan electrode SCi, similarly to the example of FIG. 6.

The first ramp voltage gradually rises from the ground potential to a positive voltage Vr. The positive voltage Vr is higher than the sustain pulse voltage Vs applied to the scan electrode SCi in the sustain period of each SF.

In this example, a second ramp voltage whose leading edge of the voltage waveform changes more gradually than its trailing edge is applied to the scan electrode SCi before the end of the sustain periods of the first to ninth SFs, that is, of the SFs excluding the last SF while the sustain electrode SUi and the data electrode Dj are held at the ground potential as shown in FIG. 7. The second ramp voltage is used for generating the weak erase discharge between the sustain electrode SUi and the scan electrode SCi, similarly to the example of FIG. 6. The second ramp voltage gradually rises from the ground potential to the positive voltage Vs.

As described above, in this example, the first ramp voltage is applied to the scan electrode SCi before the end of the sustain period of the last SF, and the second ramp voltage that is lower than the first ramp voltage is applied to the scan electrode SCi before the end of the sustain periods of the SFs excluding the last SF.

(5-b) The First Ramp Voltage and the Second Ramp Voltage

Description is made of the first ramp voltage and the second ramp voltage applied to the scan electrode SCi.

As described above, the second ramp voltage that gradually rises from the ground potential to the positive voltage Vs is applied to the scan electrode SCi before the end of the sustain periods of the SFs excluding the last SF in this example. This allows the large amount of the positive wall charges to remain on the scan electrode SCi and the large amount of the negative wall charges to remain on the sustain electrode SUi before the start of the write periods of the subsequent SFs. Thus, the write discharges in the write periods of the subsequent SFs can be weakened, preventing crosstalk between adjacent discharge cells DC.

On the other hand, the first ramp voltage that is higher than the second ramp voltage is applied before the end of the sustain period of the last SF in this example. The reason will be described below.

In the present embodiment, the strong discharge is generated between the sustain electrode SUi and the data electrode Dj immediately before the setup operation for all the cells in the setup period of the first SF. However, magnitude of the strong discharge varies in each discharge cell DC.

The magnitude of the strong discharge depends on a weight amount of the SF subjected to the last lighting in the preceding field (hereinafter abbreviated as the last lighting SF) in each discharge cell DC. Note that the weight amount of each SF corresponds to the number of the sustain pulses in the sustain period of the SF.

When the weight amount of the last lighting SF is small, an amount of priming generated in each discharge cell is smaller than that when the weight amount in the last lighting SF of the preceding field is large, for example. Here, the priming means an excited particle that serves as an initiating agent for the discharge.

Therefore, the discharge start voltage in each discharge cell DC is increased in the case of a small weight amount in the last lighting SF of the preceding field. In this case, when the ramp voltage applied to the scan electrode SCi is low, the weak discharge is generated only in a short period of time even though the voltage between the scan electrode SCi and the sustain electrode SUi exceeds the discharge start voltage of the discharge cell DC.

Therefore, the negative wall charges stored on the sustain electrode SUi is hardly decreased, and the negative wall charges excessively remain on the sustain electrode SUi. Accordingly, when the weight amount in the last lighting SF of the preceding field is small, the strong discharge to be generated between the sustain electrode SUi and the data electrode Dj in the setup period of the first SF of the subsequent field becomes excessive.

In this case, the stable setup discharge cannot be stably performed in the first SF of the subsequent field. In addition, the discharge cell DC emits light in the setup period where the discharge cell DC should not emit light, thereby making it difficult to display low gray levels.

Therefore, the first ramp voltage that is higher than the second ramp voltage is applied to the scan electrode SCi before the end of the sustain period of the last SF in this example. Thus, the negative wall charges stored on the sustain electrode SUi are reliably decreased by a predetermined amount even when the weight amount in the last lighting SF of the preceding field is small. As a result, the setup discharges can be stably performed, and the low gray levels can be clearly displayed.

While the second ramp voltage is set to be the same as the voltage Vs of the sustain pulse in this example, the second ramp voltage may be set higher than the voltage Vs if being lower than the voltage Vr.

(6) Still Other Examples of the Driving Waveforms (6-a) Setting of the Setup Period in the Field In the example of FIG. 4, the setup period is provided in the beginning of the first SF, which is an initial sub-field in the field. Hereinafter, description is made of an example in which the setup period is provided between predetermined sub-fields in the field.

Figure 9:
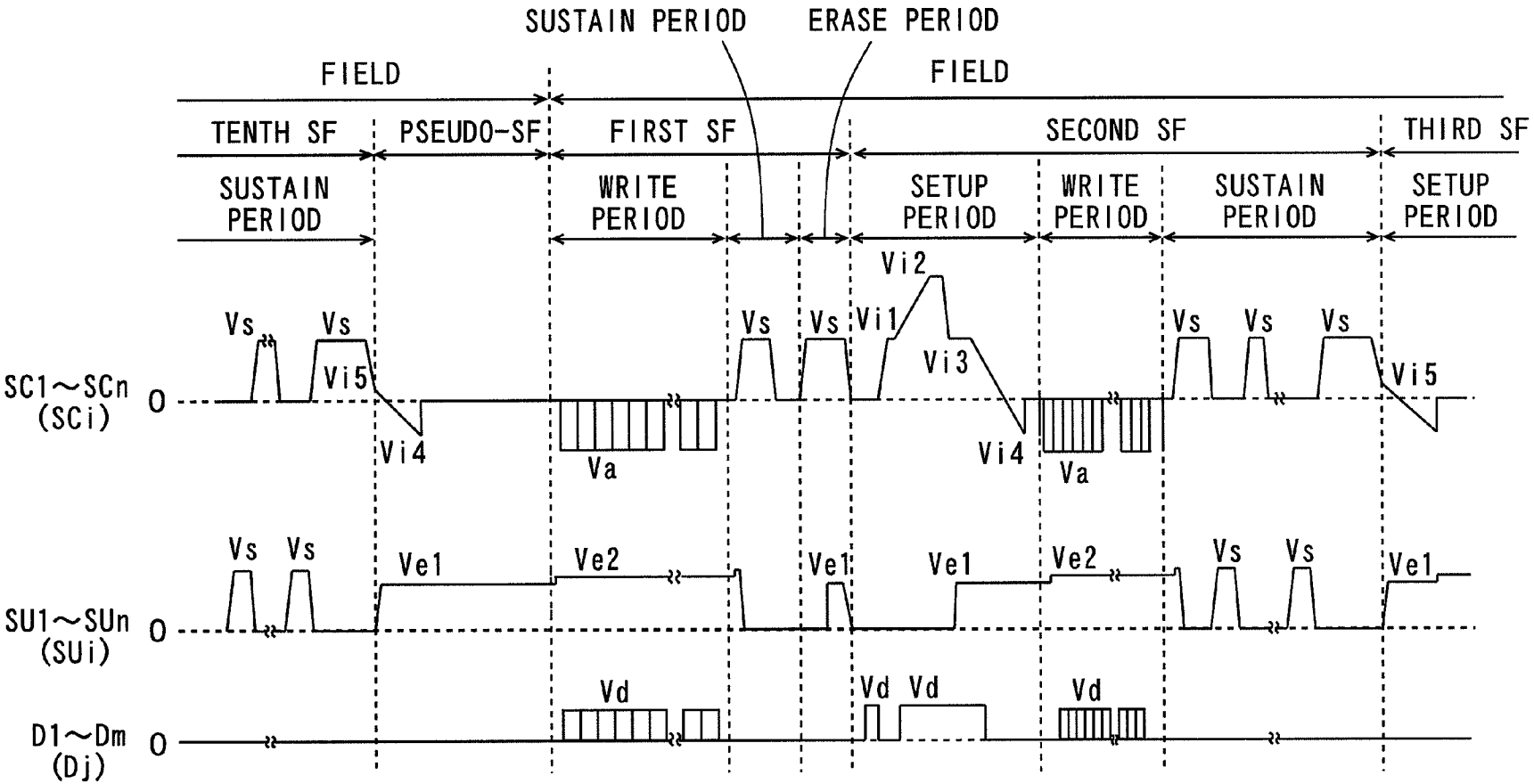
FIG. 9 is a diagram showing still other examples of the driving waveforms applied to the respective electrodes of the plasma display device according to the one embodiment of the present invention.
Figure 10:
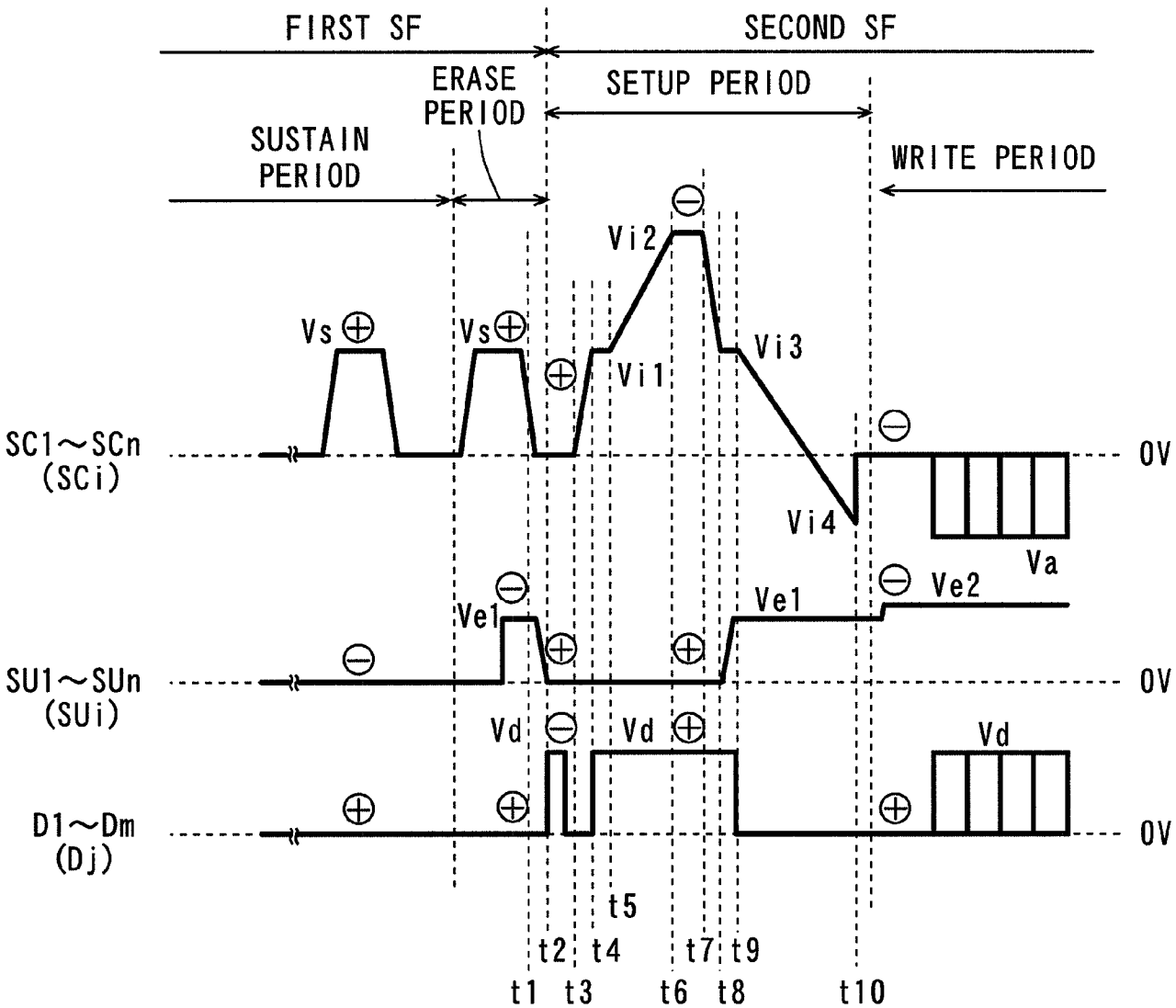
FIG. 10 is a partially enlarged view of the driving waveforms of FIG. 9.

FIG. 9 is a diagram showing still other examples of the driving waveforms applied to the respective electrodes of the plasma display device according to the one embodiment of the present invention, and FIG. 10 is a partially enlarged view of the driving waveforms of FIG. 9.

The driving waveforms shown in FIGS. 9 and 10 are different from the driving waveforms shown in FIGS. 4 and 5 in the following points. As shown in FIG. 9, the setup for all the cells is not performed in the first SF of the field after the pseudo-SF of the preceding field in the driving waveforms of this example.

That is, the first SF does not have the setup period, and the other sub-fields have the respective setup periods. The setup operation for all the cells is performed in the setup period of the second SF after an erase operation has been performed in the first SF.

FIG. 9 shows periods from the sustain period of the tenth SF of a field preceding one field to the setup period of the third SF of the one field.

In the write period of the first SF, the scan pulse having the negative voltage Va is applied to the scan electrode SCi and the write pulse having the positive voltage Vd is applied to the data electrode Dk, similarly to the write period described referring to FIG. 4.

This generates the write discharges between the data electrode Dk and the scan electrode SC1 and between the sustain electrode SU1 and the scan electrode SC1. This write operation is sequentially performed in the discharge cells on the first row to the n-th row, and the write period is then finished.

In the subsequent sustain period, the sustain electrode SUi is returned to the ground potential, and the sustain pulse having the voltage Vs is applied to the scan electrode SCi, similarly to the sustain period described referring to FIG. 4.

This induces the sustain discharge between the scan electrode SCi and the sustain electrode SUi in the discharge cell DC in which the write discharge has been generated in the write period, causing the discharge cell DC to emit light.

Similarly to this, a predetermined number of sustain pulses are alternately applied to the scan electrode SCi and the sustain electrode SUi, so that the sustain discharges are continuously performed in the discharge cell in which the write discharge has been generated in the write period.

Here, in this first SF, an erase period following the sustain period is provided before the start of the second SF as shown in FIG. 10.

In the erase period, the voltage of the sustain electrode SUi is raised to Ve1 after the predetermined period of time (the phase difference TR), which is set small, since the voltage of the scan electrode SCi is raised to Vs, similarly to the end of the sustain period of the tenth SF of the preceding field described referring to FIGS. 4 and 5.

Thus, the weak erase discharge is generated between the scan electrode SCi and the sustain electrode SUi. This allows a large amount of positive wall charges to remain on the scan electrode SCi and a large amount of negative wall charges to remain on the sustain electrode SUi. In this state, the first SF is finished.

After that, as shown in FIG. 10, the setup operation for all the cells that is the same as the example of FIGS. 4 and 5 is performed in the setup period set in the beginning of the second SF. Then, the write operation and the sustain operation that are the same as the example of FIGS. 4 and 5 are performed in the write period and the sustain period in the second SF.

Although the third to tenth SFs following the second SF have the setup periods, the write periods and the sustain periods, respectively, the selective setup operations are performed in those setup periods.

As described above, the setup period where the setup operation for all the cells is performed may be provided between predetermined sub-fields in a field in the plasma display device according to the present embodiment.

(7) Circuit Configuration and Operation Control of the Scan Electrode Driving Circuit 53

(7-a) Circuit Configuration

Figure 11:
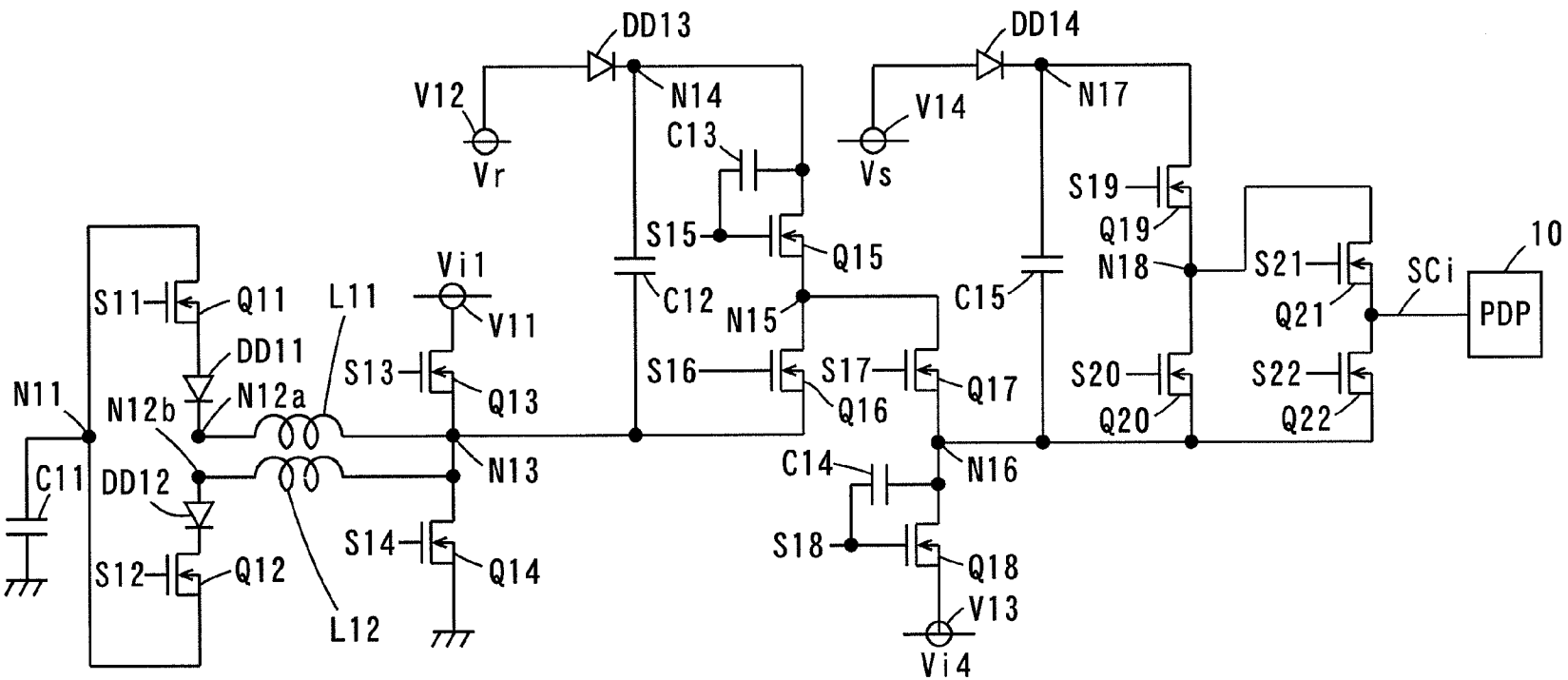
FIG. 11 is a circuit diagram showing the configuration of a scan electrode driving circuit of FIG. 1.

FIG. 11 is a circuit diagram showing the configuration of the scan electrode driving circuit 53 of FIG. 3. While an example of the positive-polarity pulse that performs the discharge at the time of the rise of the driving voltage is shown in the following description, the negative-polarity pulse that performs the discharge at the time of the drop may be employed.

The scan electrode driving circuit 53 shown in FIG. 11 includes FETs (Field-Effect Transistors; hereinafter abbreviated as transistors) Q11 to Q22, a recovery capacitor C11, capacitors C12 to C15, recovery coils L11, L12, power supply terminals V11 to V14 and diodes DD11 to DD14.

The transistor Q13 of the scan electrode driving circuit 53 is connected between the power supply terminal V11 and a node N13, and a control signal S13 is input to a gate. The voltage Vi1 is applied to the power supply terminal V11. The transistor Q14 is connected between the node N13 and a ground terminal, and a control signal S14 is input to a gate.

The recovery capacitor C11 is connected between a node N11 and a ground terminal. The transistor Q11 and the diode DD11 are connected in series between the node N11 and a node N12*a*. The diode DD12 and the transistor Q12 are connected in series between a node N12*b* and the node N11. A control signal S11 is input to a gate of the transistor Q11, and a control signal S12 is input to a gate of the transistor Q12. The recovery coil L11 is connected between the node N12*a* and the node N13. The recovery coil L12 is connected between the node N12*b* and the node N13.

The capacitor C12 is connected between a node N14 and the node N13. The diode DD13 is connected between the power supply terminal V12 and the node N14. The voltage Vr is applied to the power supply terminal V12.

The transistor Q15 is connected between the node N14 and a node N15, and a control signal S15 is input to a gate. The capacitor C13 is connected between the node N14 and the gate of the transistor Q15. The transistor Q16 is connected between the node N15 and the node N13, and a control signal S16 is input to a gate.

The transistor Q17 is connected between the node N15 and a node N16, and a control signal S17 is input to a gate. The transistor Q18 is connected between the node N16 and the power supply terminal V13, and a control signal S18 is input to a gate. The voltage Vi4 is applied to the power supply terminal V13. The capacitor C14 is connected between the node N16 and the gate of the transistor Q18.

The capacitor C15 is connected between the node N16 and a node N17. The diode DD14 is connected between the power supply terminal V14 and the node N17. The voltage Vs is applied to the power supply terminal V14.

The transistor Q19 is connected between the node N17 and a node N18, and a control signal S19 is input to a gate. The transistor Q20 is connected between the node N18 and the node N16, and a control signal S20 is input to a gate.

The transistor Q21 is connected between the node N18 and the scan electrode SCi, and a control signal S21 is input to a gate. The transistor Q22 is connected between the node N16 and the scan electrode SCi, and a control signal S22 is input to a gate.

The foregoing control signals S11 to S22 are supplied from the timing generating circuit 55 of FIG. 2 to the scan electrode driving circuit 53 as the timing signals.

(7-b) Operation Control

Figure 12:
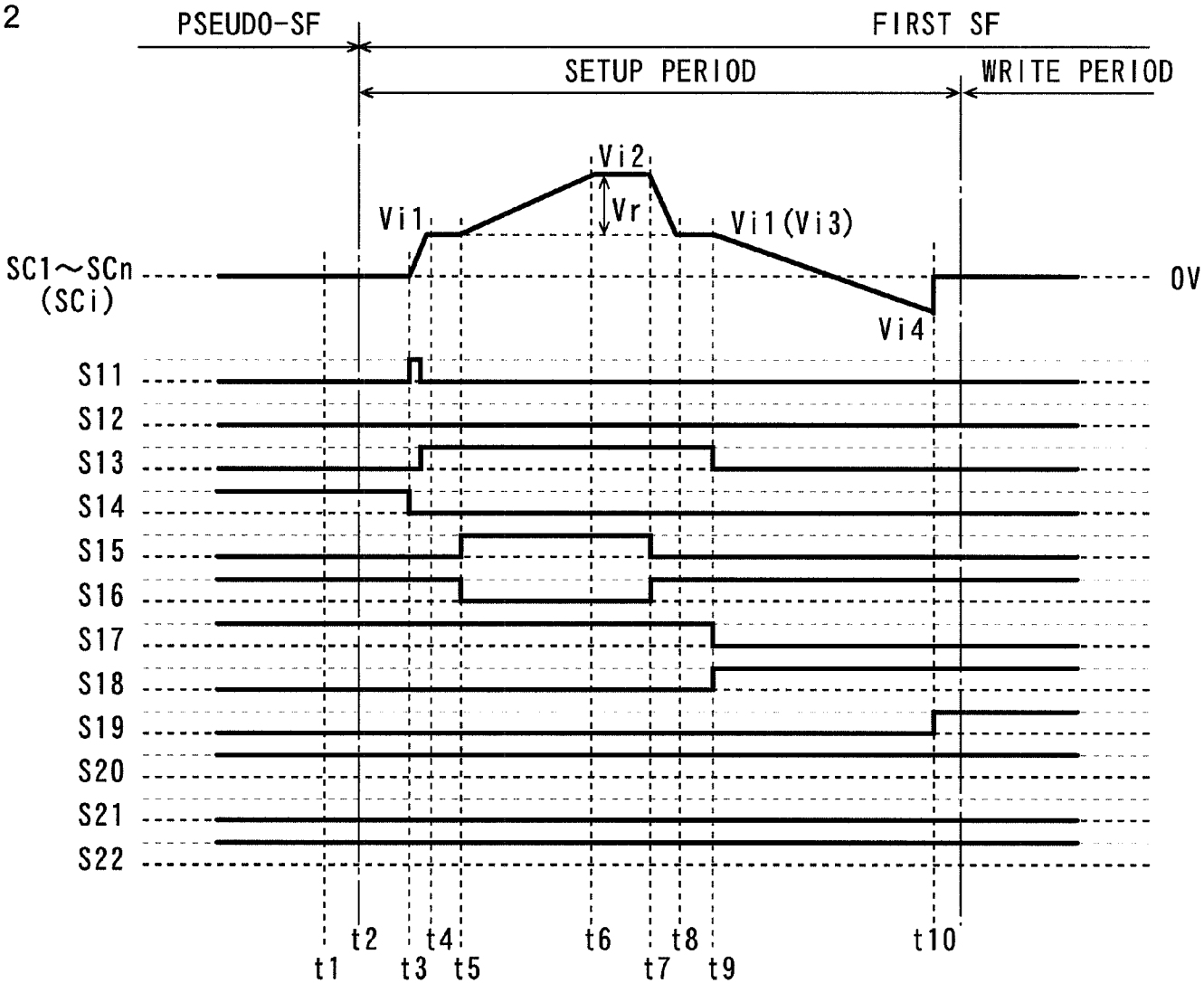
FIG. 12 is a timing chart of control signals supplied to the scan electrode driving circuit of FIG. 11 in a setup period of a first SF of FIG. 5.

FIG. 12 is a timing chart of the control signals S11 to S22 supplied to the scan electrode driving circuit 53 of FIG. 11 in the setup period of the first SF of FIG. 5.

At the starting time point t2 of the first SF, the control signals S11, S12, S13, S15, S18, S19, S21 are at a low level. Thus, the transistors Q11, Q12, Q13, Q15, Q18, Q19, Q21 are turned off.

The control signals S14, S16, S17, S20, S22 are at a high level. Thus, the transistors Q14, Q16, Q17, Q20, Q22 are turned on. In this case, the voltage of the scan electrode SCi is at the ground potential.

At the time point t3, the control signal S11 attains a high level and the control signal S14 attains a low level. Thus, the transistor Q11 is turned on and the transistor Q14 is turned off. This causes a current to flow from the recovery capacitor C11 to the scan electrode SCi, causing the voltage of the scan electrode SCi to rise.

In addition, the control signal S11 attains a low level immediately after the time point t3. This causes the transistor Q11 to be turned off. At the same time, the control signal S13 attains a high level. This causes the transistor Q13 to be turned on.

In this case, the current flowing from the recovery capacitor C11 to the scan electrode SCi is shut off, and the current flows from the power supply terminal V11 to the scan electrode SCi. This causes the voltage of the scan electrode SCi to rise to reach Vi1 at the time point t4.

Next, the control signal S15 attains a high level and the control signal S16 attains a low level at the time point t5. This causes the transistor Q15 to be turned on and the transistor Q16 to be turned off.

In this case, the current flows from the power supply terminal V12 to the scan electrode SCi while the current flowing from the power supply terminal V11 to the scan electrode SCi is shut off. At this time, since the voltage at the node N15 is held at Vi1, the voltage of the scan electrode SCi gradually rises to reach Vi2, that is, (Vi1+Vr) at the time point t6.

Then, the control signal S15 attains a low level and the control signal S16 attains a high level at the time point t7. This causes the transistor Q15 to be turned off and the transistor Q16 to be turned on. Thus, the voltage of the scan electrode SCi drops to attain the voltage Vi1 (the foregoing voltage Vi3) of the power supply terminal V11 at the time point t8.

Next, the control signal S13 attains a low level, the control signal S17 attains a low level, and the control signal S18 attains a high level at the time point t9. This causes the transistor Q13 to be turned off, the transistor Q17 to be turned off, and the transistor Q18 to be turned on. In this case, the voltage of the scan electrode SCi gradually drops to attain the voltage Vi4 of the power supply terminal V13 at the time point t10.

At the time point t10, the control signal S19 attains a high level, causing the transistor Q19 to be turned on. This causes the voltage Vs of the power supply terminal V14 to be applied to the scan electrode SCi, so that the voltage of the scan electrode SCi is substantially at the ground potential.

In the foregoing configuration, a ramp waveform (not shown) changing in a curve may be supplied to the scan electrode SCi by adjusting the capacitance of the capacitor C13, for example.

(8) Circuit Configuration and Operation Control of the Sustain Electrode Driving Circuit 54

(8-a) Circuit Configuration

Figure 13:
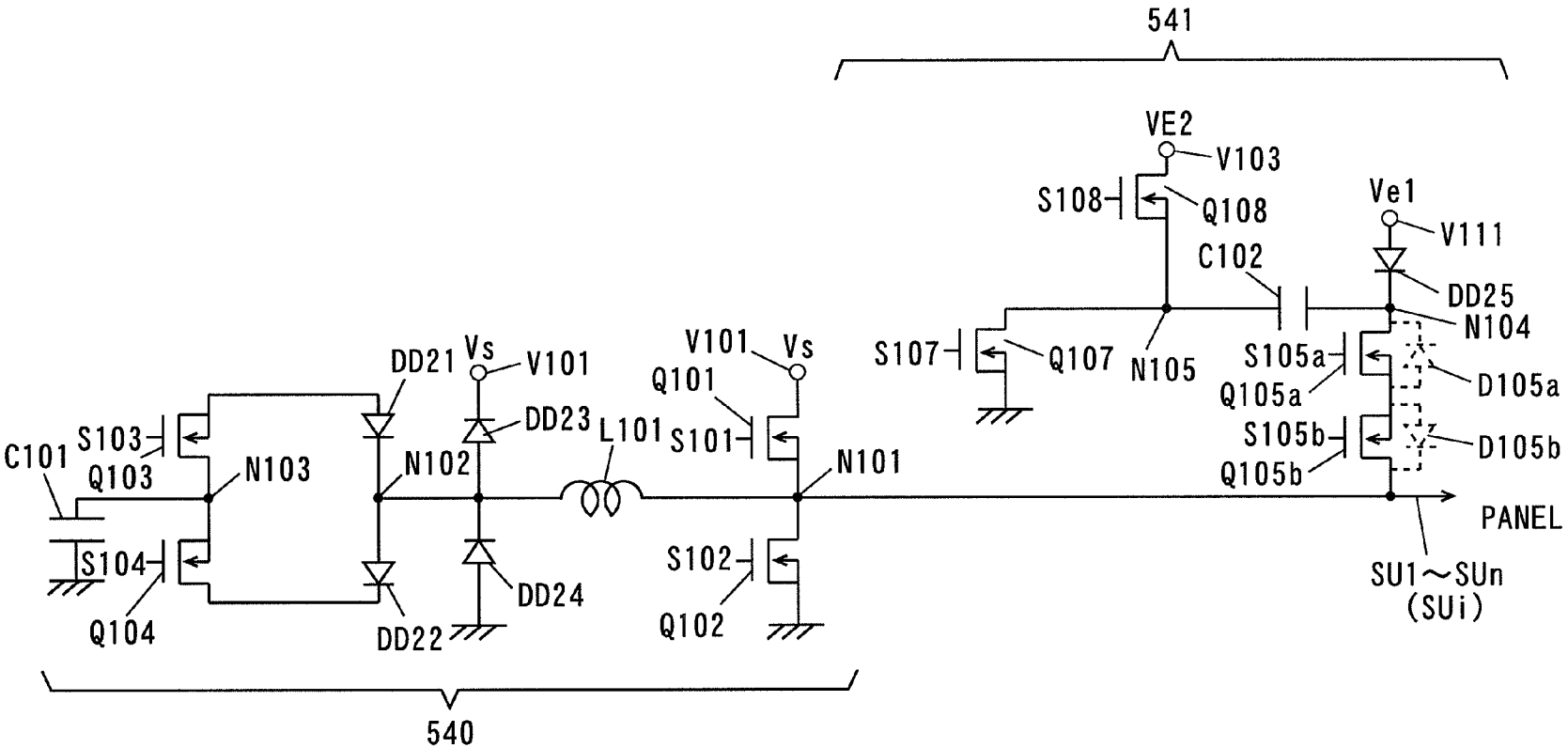
FIG. 13 is a circuit diagram showing the configuration of a sustain electrode driving circuit of FIG. 3.

FIG. 13 is a circuit diagram showing the configuration of the sustain electrode driving circuit 54 of FIG. 3.

The sustain electrode driving circuit 54 of FIG. 13 includes a sustain driver 540 and a voltage raising circuit 541.

The sustain driver 540 of FIG. 13 includes n-channel FETs (Field-Effect Transistors; hereinafter abbreviated as transistors) Q101 to Q104, a recovery capacitor C101, a recovery coil L101 and diodes DD21 to DD24.

The voltage raising circuit 541 includes n-channel FETs (Field-Effect Transistors; hereinafter abbreviated as transistors) Q105*a*, Q107, Q108, p-channel FETs (Field-Effect Transistors; hereinafter abbreviated as transistors) Q105*b*, a diode DD25 and a capacitor C102.

The transistor Q101 of the sustain driver 540 is connected between a power supply terminal V101 and a node N101, and a control signal S101 is input to a gate. The voltage Vs is applied to the power supply terminal V101.

The transistor Q102 is connected between the node N101 and a ground terminal, and a control signal S102 is input to a gate. The node N101 is connected to the sustain electrode SUi of FIG. 2.

The recovery capacitor C101 is connected between a node N103 and a ground terminal. The transistor Q103 and the diode DD21 are connected in series between the node N103 and a node N102. The diode DD22 and the transistor Q104 are connected in series between the node N102 and the node N103.

A control signal S103 is input to a gate of the transistor Q103, and a control signal S104 is input to a gate of the transistor Q104. The recovery coil L101 is connected between the node N101 and the node N102. The diode DD23 is connected between the node N102 and the power supply terminal V101, and the diode DD24 is connected between a ground terminal and the node N102.

The diode DD25 of the voltage raising circuit 541 is connected between a power supply terminal V111 and a node N104, and the voltage Ve1 is applied to the power supply terminal V111.

The transistor Q105*a* and the transistor Q105*b* are connected in series between the node N104 and the node N101. A control signal S105*a* and a control signal S105*b* are input to gates of the transistor Q105*a* and the transistor Q105*b*, respectively. The capacitor C102 is connected between the node N104 and a node N105.

The transistor Q107 is connected between the node N105 and a ground terminal, and a control signal S107 is input to a gate. The transistor Q108 is connected between a power supply terminal V103 and the node N105, and a control signal S108 is input to a gate. A voltage VE2 is applied to the power supply terminal V103. Note that the voltage VE2 satisfies a relation of VE2=Ve2−Ve1, such as VE2=5 [V], for example.

The above-mentioned control signals S101 to S104, S105*a*, S105*b*, S107, S108 are supplied from the timing generating circuit 55 of FIG. 3 to the sustain electrode driving circuit 54 as the timing signals.

(8-b) Operation Control

Figure 14:
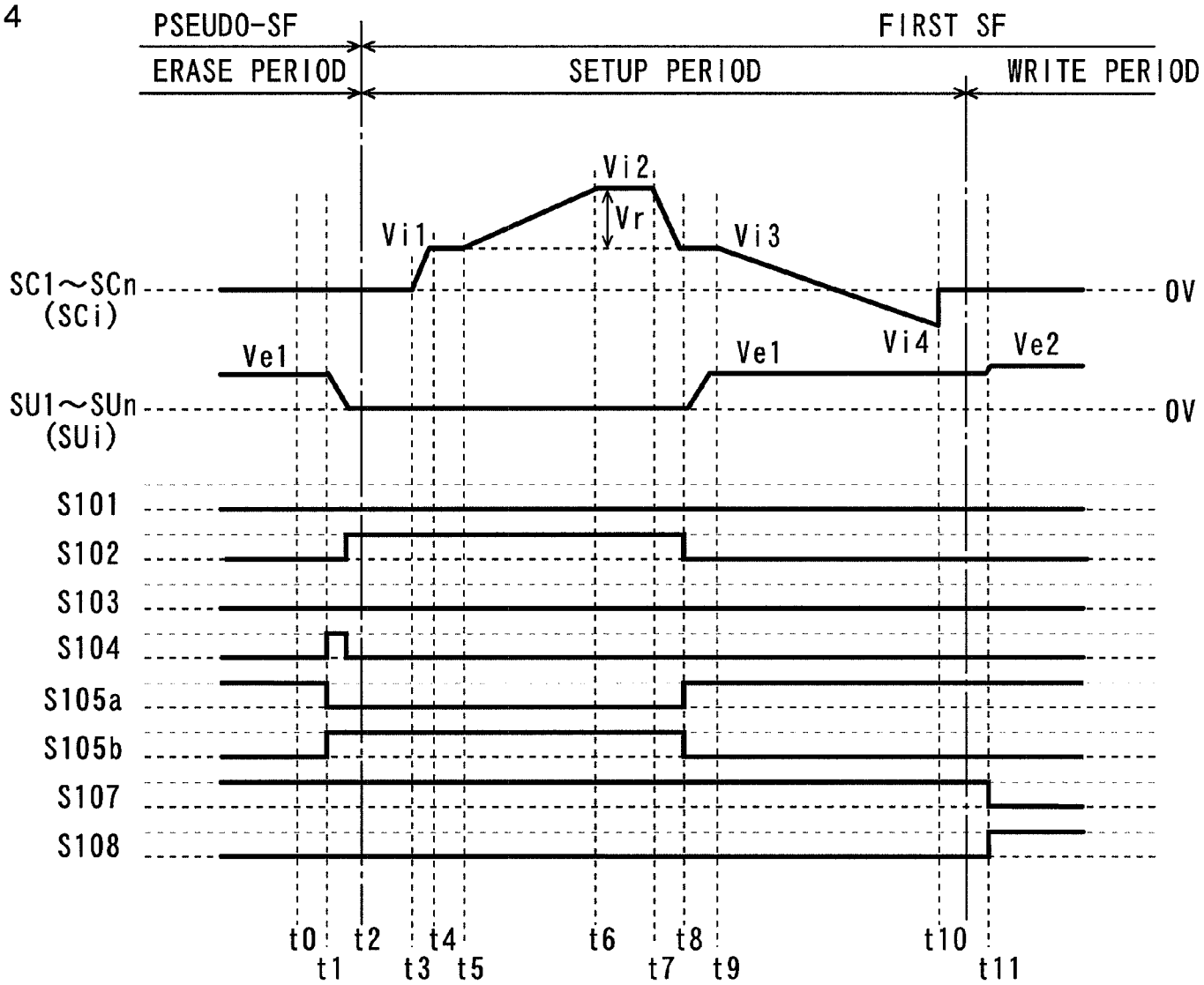
FIG. 14 is a timing chart of control signals supplied to the sustain electrode driving circuit in and before/after the setup period of the first SF of FIG. 5.

FIG. 14 is a timing chart of the control signals S101 to S104, S105*a*, S105*b*, S107, S108 supplied to the sustain electrode driving circuit 54 in and before/after the setup period of the first SF of FIG. 5. The control S105*b* has a waveform that is inverted with respect to the waveform of the control signal S105*a*.

First, the control signals S101, S102, S103, S104, S105*b*, S108 attain a low level at a time point t0 in the pseudo-SF of the preceding field. This causes the transistors Q101, Q102, Q103, Q104, Q108 to be turned off, and the transistor Q105*b* to be turned on. The control signals S105*a*, S107 attain a high level. This causes the transistors Q105*a*, Q107 to be turned on.

In this case, a current flows from the power supply terminal V111 to the sustain electrode SUi through the node N104. Thus, the voltage of the sustain electrode SUi is held at Ve1.

Next, the control signal S104 attains a high level, the control signal S105*a* attains a low level, and the control signal S105*b* attains a high level at the time point t1 immediately before the end of the pseudo-SF, that is, at the time point t1 immediately before the first SF of the next field.

Accordingly, the transistor Q104 is turned on, and the transistors Q105*a*, Q105*b* are turned off. This causes the current to flow from the sustain electrode SUi (the node N101) to the recovery capacitor C101 through the recovery coil L101, the diode DD22 and the transistor Q104. At this time, charges of a panel capacitance are recovered to the recovery capacitor C101. As a result, the voltage of the sustain electrode SUi (the node N101) drops.

In addition, the control signal S104 attains a low level, and the control signal S102 attains a high level immediately after the time point t1. This causes the transistor Q104 to be turned off and the transistor Q102 to be turned on. Accordingly, the node N101 is grounded, and the sustain electrode SUi attains the ground potential.

The control signal S102 is in a high level in a period from the starting time point t2 of the first SF of the next field to the time point t8 where the voltage of the scan electrode SCi starts dropping from the voltage Vi3 to the voltage Vi4. Accordingly, the sustain electrode SUi (the node N101) is held at the ground potential.

Here, the control signal S102 attains a low level, the control signal S105*a* attains a high level, and the control signal S105*b* attains a low level at the time point t8. This causes the transistor Q102 to be turned off, and the transistors Q105*a*, Q105*b* to be turned on. Thus, the current flows again from the power supply terminal V111 to the sustain electrode SUi through the node N104. Accordingly, the voltage of the sustain electrode SUi is held at Ve1.

The setup period is finished, and then the control signal S107 attains a low level, and the control signal S108 attains a high level at a time point t11 immediately after the start of the write period. This causes the transistor Q107 to be turned off and the transistor Q108 to be turned on. Thus, the current flows from the power supply terminal V103 to the node N105 through the transistor Q108. As a result, the voltage at the node N105 rises to VE2. In this case, the voltage VE2 is added to the voltage Ve1 of the sustain electrode SUi. Accordingly, the voltage of the sustain electrode SUi (the node N101) rises to Ve2.

(9) Circuit Configuration and Operation Control of the Data Electrode Driving Circuit 52

(9-a) Circuit Configuration

Figure 15:
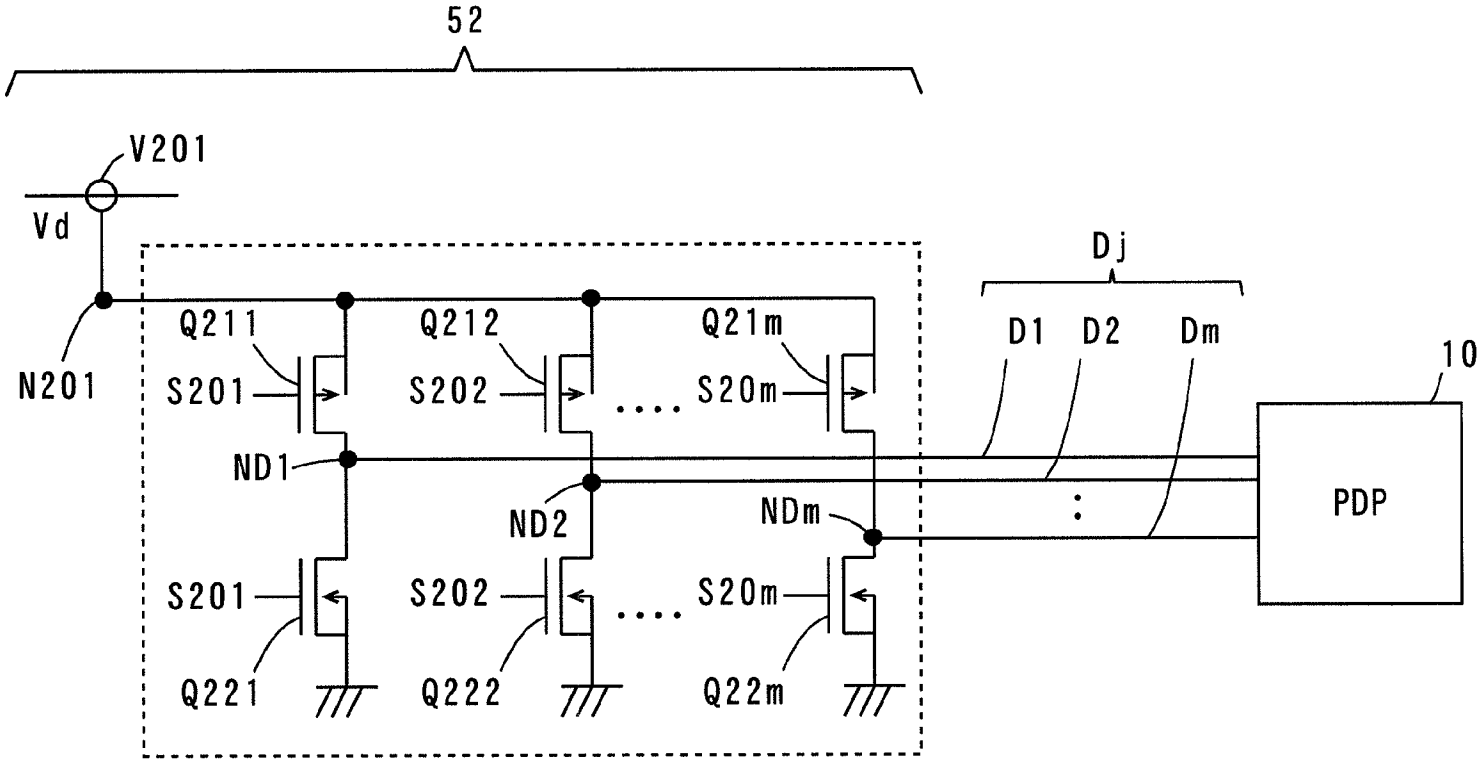
FIG. 15 is a circuit diagram showing the configuration of a data electrode driving circuit of FIG. 3.

FIG. 15 is a circuit diagram showing the configuration of the data electrode driving circuit 52 of FIG. 3.

The data electrode driving circuit 52 of FIG. 15 includes a plurality of p-channel FETs (Field-Effect Transistors; hereinafter abbreviated as transistors) Q211 to Q21m and a plurality of n-channel FETs (Field-Effect Transistors; hereinafter abbreviated as transistors) Q221 to Q22m.

A power supply terminal V201 is connected to a node N201. The voltage Vd is applied to the power supply terminal V201.

The transistors Q211 to Q21m are connected between the node N201 and nodes ND1 to NDm, respectively. The transistors Q221 to Q22m are connected between the nodes ND1 to NDm and ground terminals, respectively. Each of the nodes ND1 to NDm is connected to the data electrode Dj of FIG. 2.

Control signals S201 to S20m are input to gates of the plurality of transistors Q211 to Q21m, respectively. Also, the control signals S201 to S20m are input to gates of the transistors Q221 to Q22m, respectively.

The foregoing control signals S201 to S20m are supplied from the timing generating circuit 55 of FIG. 2 to the data electrode driving circuit 52 as the timing signals.

(9-b) Operation Control

Figure 16:
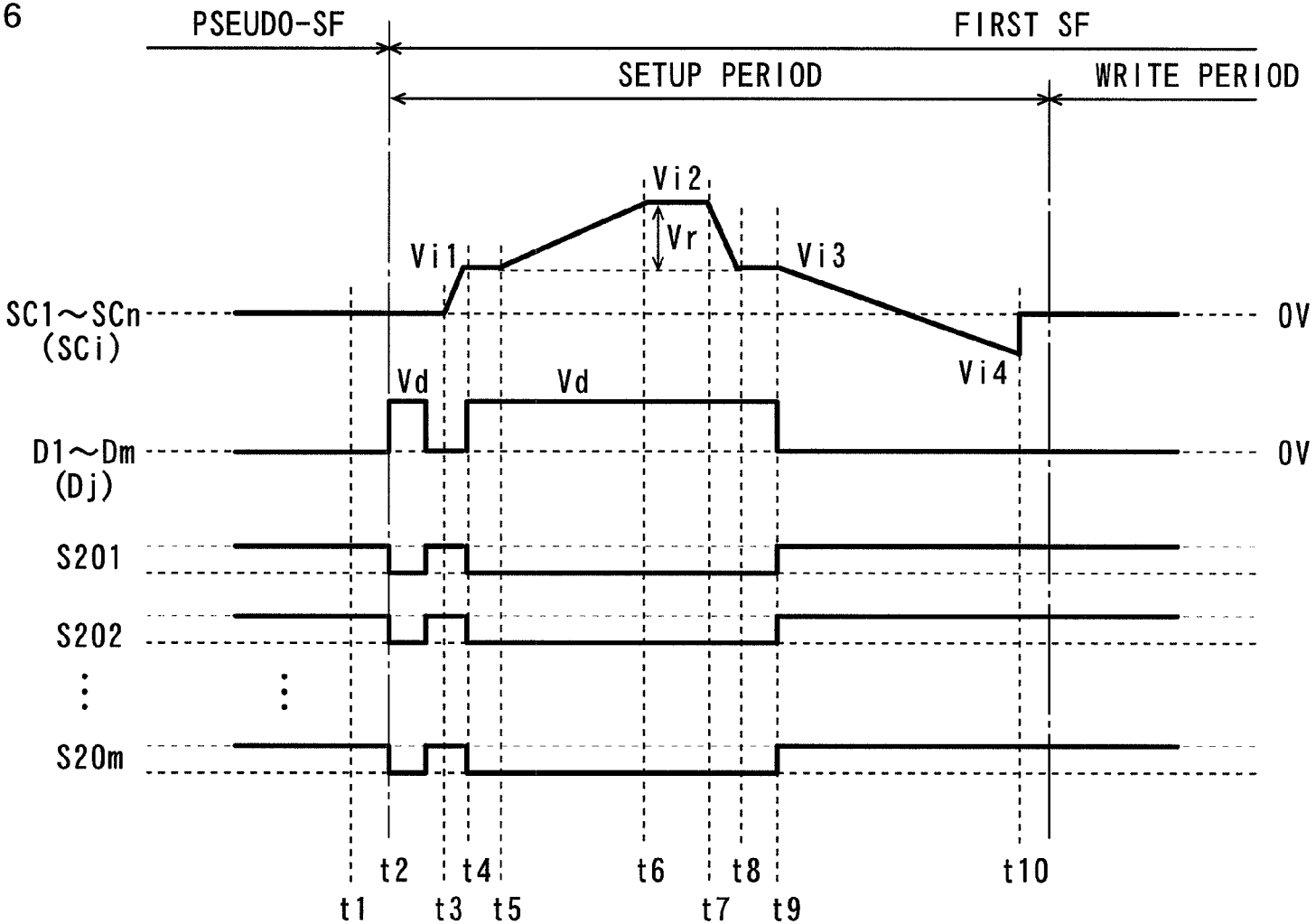
FIG. 16 is a timing chart of control signals supplied to the data electrode driving circuit in the setup period of the first SF of FIG. 5.

FIG. 16 is a timing chart of the control signals S201 to S20m supplied to the data electrode driving circuit 52 in the setup period of the first SF of FIG. 5.

As shown in FIG. 16, the control signals S201 to S20m attain a high level at the time point t1 immediately before the first SF. This causes the transistors Q211 to Q21m to be turned off, and the transistors Q221 to Q22m to be turned on.

In this case, the nodes ND1 to NDm are connected to the ground terminals through the transistors Q221 to Q22m. Accordingly, the data electrode Dj attains the ground potential.

Next, the control signals S201 to S20m attain a low level at the starting time point t2 of the first SF. This causes the transistors Q211 to Q21m to be turned on and the transistors Q221 to Q22m to be turned off.

In this case, the nodes ND1 to NDm are connected to the node N201 through the transistors Q211 to Q21m. This causes the current to flow from the power supply terminal V201 to the data electrode Dj through the node N201 and each of the transistors Q211 to Q21m. Thus, the voltage of the data electrode Dj is held at Vd.

In a period from the time point t2 to the time point t3, the control signals S201 to S20m attain a high level after a predetermined period of time has elapsed since the time point t2. In this case, the data electrode Dj attains the ground potential as described above.

After that, the control signals S201 to S20m again attain a low level at the time point t4. The control signals S201 to S20m are held at a low level in a period from the time point t4 to the time point t9. This causes the voltage of the data electrode Dj to be held at Vd.

At the time point t9, the control signals S201 to S20m attain a high level. The control signals S201 to S20m are held at a high level in a period from the time point t9 to the end of the setup period. This causes the data electrode Dj to be held at the ground potential.

(10) Another Circuit Configuration and Operation Control of the Scan Electrode Driving Circuit 53

(10-a) Circuit Configuration

Figure 17:
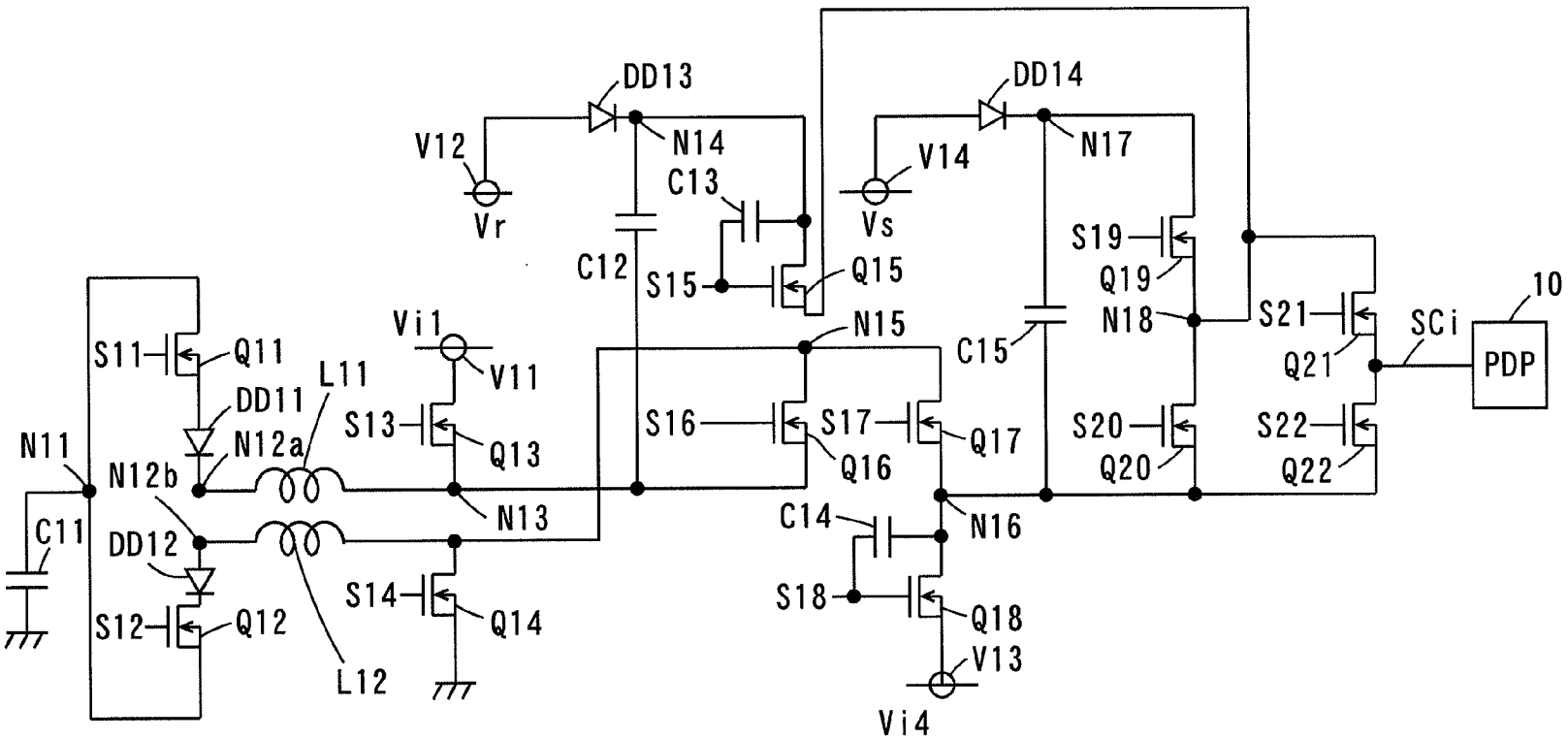
FIG. 17 is a circuit diagram showing another configuration of the scan electrode driving circuit of FIG. 3.

In the present embodiment, the scan electrode driving circuit 53 having the following configuration may be employed. FIG. 17 is a circuit diagram showing another configuration of the scan electrode driving circuit 53 of FIG. 3. While an example of the positive-polarity pulse that performs the discharge at the time of the rise of the driving voltage is shown in the following description, the negative-polarity pulse that performs the discharge at the time of the drop may be employed.

The scan electrode driving circuit 53 of this example is different from the configuration of the scan electrode driving circuit 53 of FIG. 11 in the following points.

As shown in FIG. 17, the transistor Q15 is connected between the node N14 and the node N18 in the scan electrode driving circuit 53 of this example. Similarly to the example of FIG. 11, the control signal S15 is input to the gate.

Moreover, the transistor Q14 is connected between the node N15 and the ground terminal, and the control signal S14 is input to the gate. The recovery coil L12 is connected between the node N15 and the node N12*b*.

(10-b) Operation Control

Figure 18:
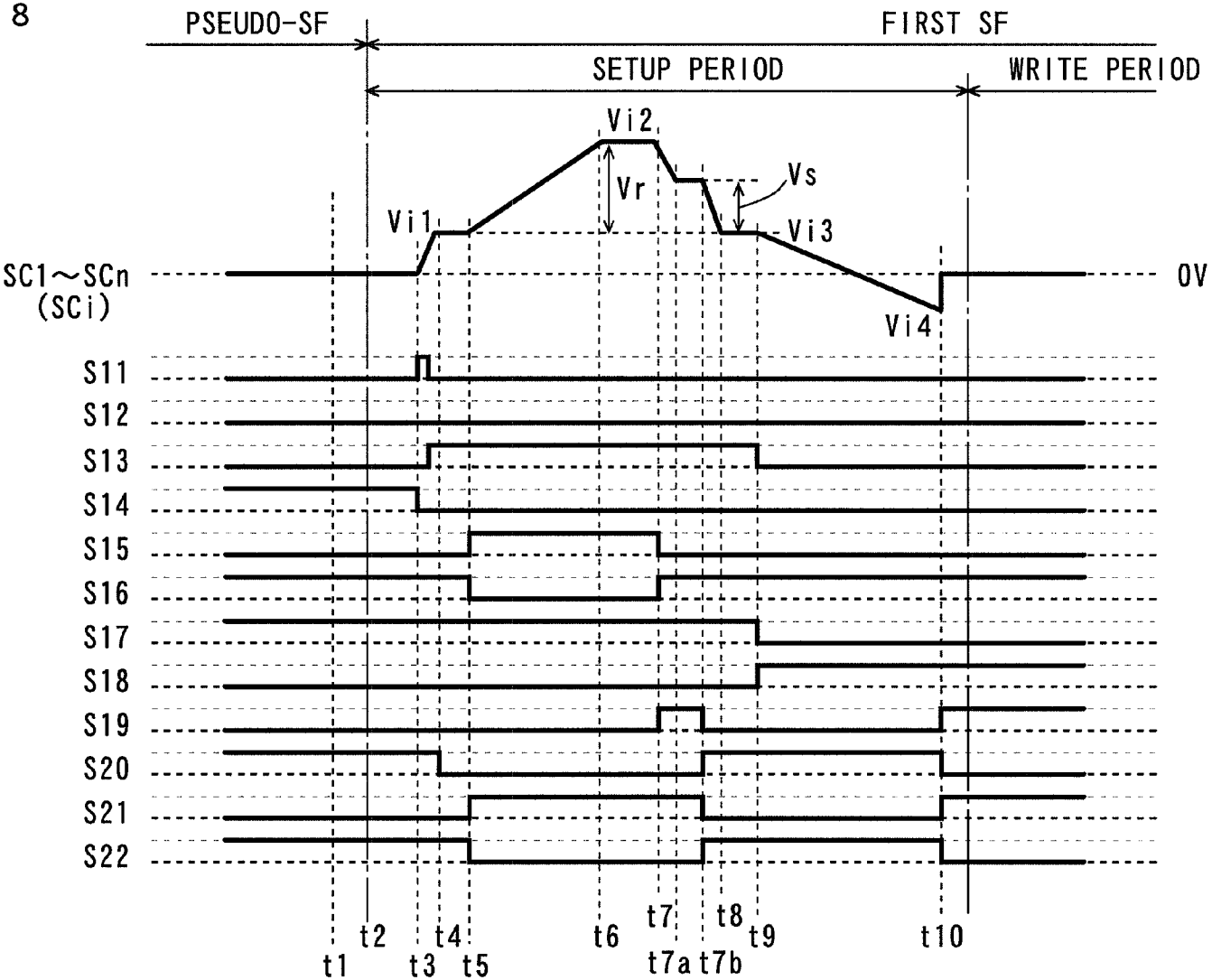
FIG. 18 is a timing chart of the control signals supplied to the scan electrode driving circuit of FIG. 17 in the setup period of the first SF of FIG. 5.

FIG. 18 is a timing chart of the control signals S11 to S22 supplied to the scan electrode driving circuit 53 of FIG. 17 in the setup period of the first SF of FIG. 5.

The control signals S11 to S22 supplied to the scan electrode driving circuit 53 of FIG. 17 are the same as the control signals S11 to S22 supplied to the scan electrode driving circuit 53 of FIG. 11 except for the following points.

According to the example of FIG. 18, the control signal S20 is maintained in a high level until the time point t4. In this case, the transistor Q20 is turned on. The transistors Q11, Q12, Q14, Q15, Q18, Q19, Q21 are turned off, and the transistors Q13, Q16, Q17, Q20, Q22 are turned on immediately before the time point t4. This causes the current to flow from the power supply terminal V11 to the scan electrode SCi. Accordingly, the voltage of the scan electrode SCi rises to Vi1.

The control signal S20 attains a low level at the time point t4. This causes the transistor Q20 to be turned off. In addition, the control signals S15, S21 attain a high level, and the control signals S16, S22 attain a low level at the time point t5. This causes the transistors Q15, Q21 to be turned on and the transistors Q16, Q22 to be turned off.

In this case, the current flows from the power supply terminal V12 to the scan electrode SCi while the current flowing from the power supply terminal V11 to the scan electrode SCi is shut off. At this time, since the voltage at the node N16 is held at Vi1, the voltage of the scan electrode SCi gradually rises to attain Vi2, that is, (Vi1+Vr) at the time point t6.

Next, the control signal S15 attains a low level, and the control signals S16, S19 attain a high level at the time point t7. This causes the transistor Q15 to be turned off and the transistors Q16, Q19 to be turned on. In this case, the current flows from the power supply terminal V14 to the scan electrode SCi while the current flowing from the power supply terminal V12 to the scan electrode SCi is shut off. Accordingly, the voltage of the scan electrode SCi drops. At this time, since the voltage at the node N16 is held at Vi1, the voltage of the scan electrode SCi is held at (Vi1+Vs) at a time point t7*a*.

Next, the control signals S19, S21 attain a low level, and the control signals S20, S22 attain a high level at a time point t7*b*. This causes the transistors Q19, Q21 to be turned off and the transistors Q20, Q22 to be turned on. In this case, the current flows from the power supply terminal V11 to the scan electrode SCi while the current flowing from the power supply terminal V14 to the scan electrode SCi is shut off. Thus, the voltage of the scan electrode SCi drops to Vi1 at the time point t8.

Next, the control signals S13, S17 attain a low level, and the control signal S18 attains a high level at the time point t9. This causes the transistors Q13, Q17 to be turned off and the transistor Q18 to be turned on. In this case, the voltage of the scan electrode SCi gradually drops to attain the voltage Vi4 of the power supply terminal V13 at the time point t10.

At the time point t10, the control signals S19, S21 attain a high level, and the control signals S20, S22 attain a low level. This causes the transistors Q19, Q21 to be turned on and the transistors Q20, Q22 to be turned off. Thus, the voltage of the scan electrode SCi is substantially at the ground potential.

(11) Still Another Circuit Configuration and Operation Control of the Scan Electrode Driving Circuit 53

(11-a) Circuit Configuration

Figure 19:
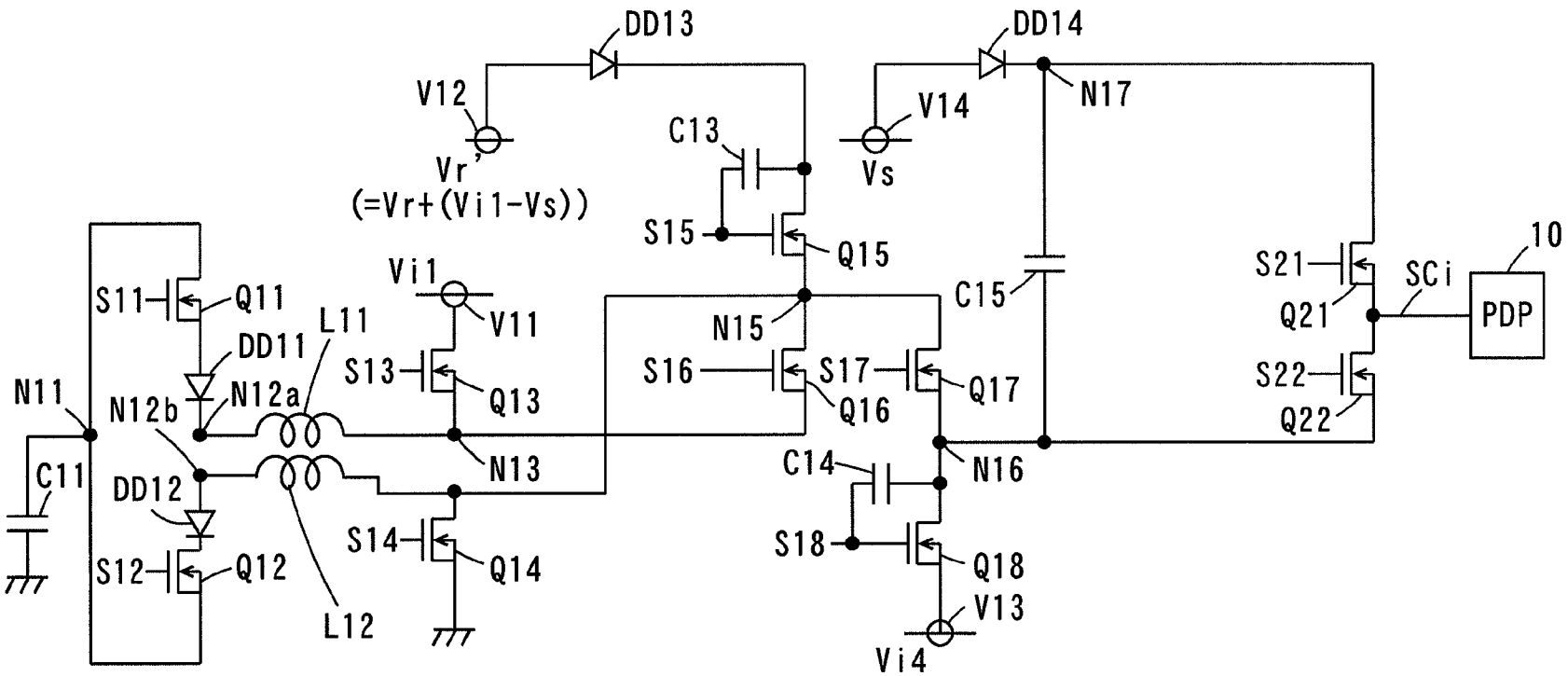
FIG. 19 is a circuit diagram showing still another configuration of the scan electrode driving circuit of FIG. 3.

FIG. 19 is a circuit diagram showing still another configuration of the scan electrode driving circuit 53 of FIG. 3. While an example of the positive-polarity pulse that performs the discharge at the time of the rise of the driving voltage is shown in the following description, the negative-polarity pulse that performs the discharge at the time of the drop may be employed.

The scan electrode driving circuit 53 of this example is different from the configuration of the scan electrode driving circuit 53 of FIG. 11 in the following points.

As shown in FIG. 19, the scan electrode driving circuit 53 of this example is not provided with the transistors Q19, Q20 and the capacitor C12, which are provided in the scan electrode driving circuit 53 of FIG. 11.

Moreover, the transistor Q21 is connected between the node N17 and the scan electrode SCi, and the control signal S21 is input to the gate. The transistor Q22 is connected between the node N16 and the scan electrode SCi, and the control signal S22 is input to the gate.

The recovery coil L12 is connected between the node N15 and the node N12*b*. A voltage Vr' instead of the voltage Vr is applied to the power supply terminal V12. Note that the voltage Vr' is obtained by adding a voltage (Vi1−Vs) to the voltage Vr.

(11-b) Operation Control

Figure 20:
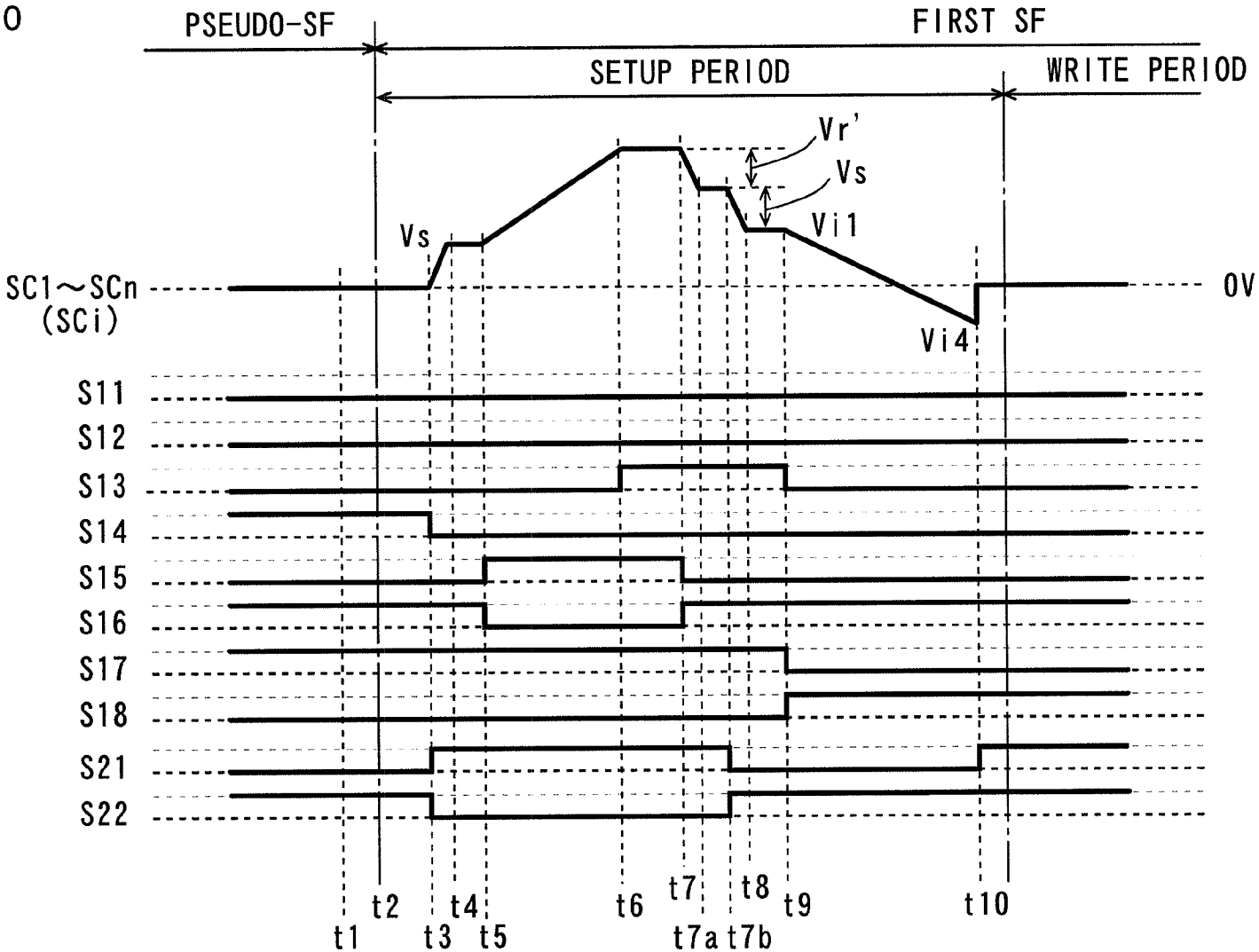
FIG. 20 is a timing chart of the control signals supplied to the scan electrode driving circuit of FIG. 19 in the setup period of the first SF of FIG. 5.

FIG. 20 is a timing chart of the control signals S11 to S18, S21, S22 supplied to the scan electrode driving circuit 53 of FIG. 19 in the setup period of the first SF of FIG. 5.

As shown in FIG. 20, in the scan electrode driving circuit 53 of FIG. 19, the driving waveforms applied to the scan electrode SCi in the setup period are slightly different from the driving waveforms of FIG. 5. First, the driving waveforms applied to the scan electrode SCi of this example will be described.

According to the driving waveforms of FIG. 20, after the setup period is started, the voltage applied to the scan electrode SCi rises to Vs in a period from the time point t3 to the time point t4 to be held.

Then, a ramp voltage gradually rising from the voltage Vs by the voltage Vr' is applied to the scan electrode SCi in the period from the time point t5 to the time point t6. Then, the voltage applied to the scan electrode SCi is held at (Vs+Vr') in a period from the time point t6 to the time point t7.

The voltage applied to the scan electrode SCi drops by the voltage Vr' in a period from the time point t7 to the time point t7*a* to be held at (Vs+Vi1). After that, the voltage applied to the scan electrode SCi drops by the voltage Vs in a period from the time point t7*b* to the time point t8 to be held at Vi1.

Next, a ramp voltage dropping from the voltage Vi1 to the negative voltage Vi4 is applied to the scan electrode SCi in the period from the time point t9 to the time point t10. Finally, the voltage of the scan electrode SCi is raised from Vi4 so as to be substantially at the ground potential at the time point t10 to be held. In this state, the setup period is finished.

In order to obtain the above-described driving waveforms applied to the scan electrode SCi, the following control signals S11 to S18, S21, S22 are applied to the scan electrode driving circuit 53 of FIG. 19.

At the starting time point t2 of the first SF, the control signals S11, S12, S13, S15, S18, S19, S21 attain a low level. This causes the transistors Q11, Q12, Q13, Q15, Q18, Q21 to be turned off.

The control signals S14, S16, S17, S22 attain a high level. This causes the transistors Q14, Q16, Q17, Q22 to be turned on. In this case, the scan electrode SCi is held at the ground potential.

At the time point t3, the control signal S21 attains a high level, and the control signals S14, S22 attain a low level. This causes the transistor Q21 to be turned on and the transistors Q14, Q22 to be turned off. Thus, the voltage of the scan electrode SCi rises to Vs.

At the time point t5, the control signal S15 attains a high level and the control signal S16 attains a low level. This causes the transistor Q15 to be turned on and the transistor Q16 to be turned off. Thus, the voltage of the scan electrode SCi gradually rises from Vs by the voltage Vr' to attain (Vs+Vr') at the time point t6. Moreover, the control signal S13 attains a high level at the time point t6. This causes the transistor Q13 to be turned on. The voltage of the scan electrode SCi is held at (Vs+Vr') in the period from the time point t5 to the time point t6.

Next, the control signal S15 attains a low level and the control signal S16 attains a high level at the time point t7. This causes the transistor Q15 to be turned off and the transistor Q16 to be turned on. Accordingly, the voltage of the scan electrode SCi drops by Vr' to attain (Vs+Vi1) at the time point t7*a*. The voltage of the scan electrode SCi is held at (Vs+Vi1) in a period from the time point t7*a* to the time point t7*b*.

The control signal S21 attains a low level and the control signal S22 attains a high level at the time point t7*b*. This causes the transistor Q21 to be turned off and the transistor Q22 to be turned on. In this case, the voltage of the scan electrode SCi drops by Vs to attain Vi1 at the time point t8. The voltage of the scan electrode SCi is held at Vi1 in a period from the time point t8 to the time point t9.

At the time point t9, the control signals S13, S17 attain a low level, and the control signal S18 attains a high level. This causes the transistors Q13, Q17 to be turned off, and the transistor Q18 to be turned on. In this case, the voltage of the scan electrode SCi gradually drops to attain the voltage Vi4 of the power supply terminal V13 at the time point t10.

At the time point t10, the control signal S21 attains a high level, causing the transistor Q21 to be turned on. The voltage Vs of the power supply terminal V14 is applied to the scan electrode SCi, so that the voltage of the scan electrode SCi is substantially at the ground potential.

In the above-described configuration, a ramp waveform (not shown) changing in a curve may be supplied to the scan electrode SCi by adjusting the capacitance of the capacitor C13, for example.

(12) Still Another Circuit Configuration and Operation Control of the Scan Electrode Driving Circuit 53

(12-a) Circuit Configuration

Figure 21:
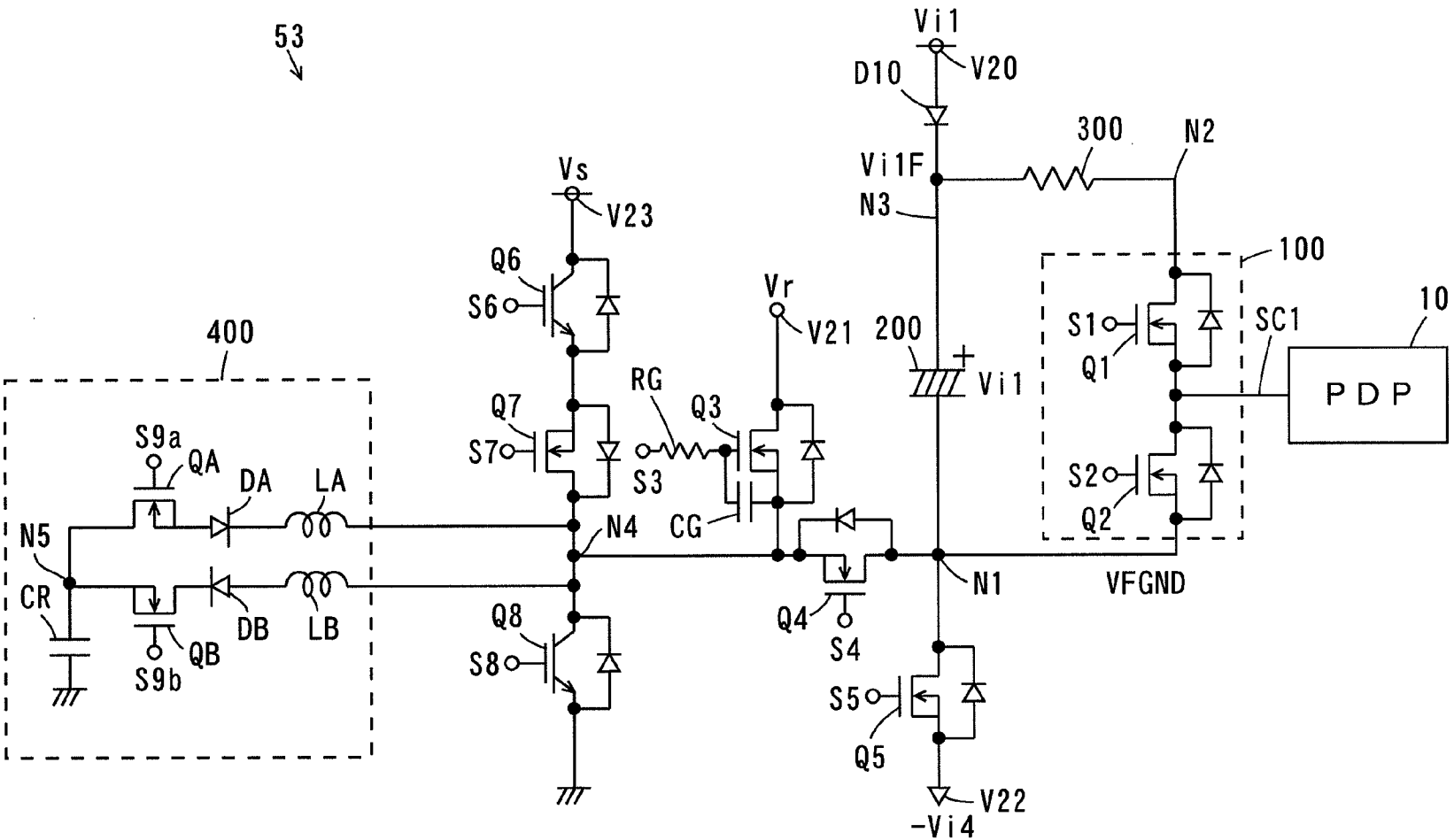
FIG. 21 is a circuit diagram showing still another configuration of the scan electrode driving circuit of FIG. 3.

FIG. 21 is a circuit diagram showing still another configuration of the scan electrode driving circuit 53 of FIG. 3. While an example of the positive-polarity pulse that performs the discharge at the time of the rise of the driving voltage is shown in the following description, the negative-polarity pulse that performs the discharge at the time of the drop may be employed.

The scan electrode drive circuit 53 includes a scan IC (Integrated Circuit) 100, a DC power supply 200, a protective resistor 300, a recovery circuit 400, a diode D10, n-channel field effect transistors (hereinafter abbreviated as transistors) Q3 to Q5, Q7 and NPN bipolar transistors (hereinafter abbreviated as transistors) Q6, Q8. One scan IC 100 connected to the one scan electrode SC1 in the scan electrode driving circuit 53 is shown in FIG. 21. The scan ICs 100 that are the same as the scan IC 100 of FIG. 21 are connected to the other scan electrodes SC2 to SCn, respectively.

The scan IC 100 includes n-channel field effect transistors (hereinafter abbreviated as a transistors) Q1, Q2. The recovery circuit 400 includes n-channel field effect transistors (hereinafter abbreviated as transistors) QA, QB, recovery coils LA, LB, a recovery capacitor CR and diodes DA, DB.

The scan IC 100 is connected between a node N1 and a node N2. The transistor Q1 of the scan IC 100 is connected between the node N2 and the scan electrode SC1, and the transistor Q2 is connected between the scan electrode SC1 and the node N1. A control signal S1 is applied to a gate of the transistor Q1, and a control signal S2 is applied to a gate of the transistor Q2.

The protective resistor 300 is connected between the node N2 and a node N3. A power supply terminal V20 that receives the voltage Vi1 is connected to the node N3 through the diode D10. The DC power supply 200 is connected between the node N1 and the node N3. The DC power supply 200 is composed of an electrolytic capacitor, and functions as a floating power supply that holds the voltage Vi1. Hereinafter, a potential of the node N1 is referred to as VFGND, and a potential of the node N3 is referred to as Vi1F. The potential Vi1F of the node N3 has a value obtained by adding the potential Vi1 to the potential VFGND of the node N1. That is, Vi1F=VFGND+Vi1.

The transistor Q3 is connected between a power supply terminal V21 that receives the voltage Vr and a node N4, and a control signal S3 is supplied to a gate. The transistor Q4 is connected between the node N1 and the node N4, and a control signal S4 is supplied to a gate. The transistor Q5 is connected between the node N1 and a power supply terminal V22 that receives the negative voltage −Vi4, and a control signal S5 is applied to a gate. The control signal S4 is an inverted signal of the control signal S5.

The transistors Q6, Q7 are connected between a power supply terminal V23 that receives the voltage Vs and the node N4. A control signal S6 is applied to a base of the transistor Q6, and a control signal S7 is applied to a gate of the transistor Q7. The transistor Q8 is connected between the node N4 and a ground terminal, and a control signal S8 is supplied to a base.

Between the node N4 and a node N5, the recovery coil LA, the diode DA and the transistor QA are connected in series, and the recovery coil LB, the diode DB and the transistor QB are connected in series. The recovery capacitor CR is connected between the node N5 and a ground terminal.

A gate resistor RG and a capacitor CG are connected to the transistor Q3 as shown in FIG. 21. Gate resistors and capacitors, not shown, are connected to the other transistors Q5, Q6, respectively.

(12-b) Operation Control in the Setup Period

The scan electrode driving circuit 53 of this example is used for obtaining the driving waveforms described with reference to FIGS. 7 and 8, for example. First, description is made of operation control of the scan electrode driving circuit 53 in the setup period and the write period of the first SF of FIGS. 7 and 8.

Figure 22:
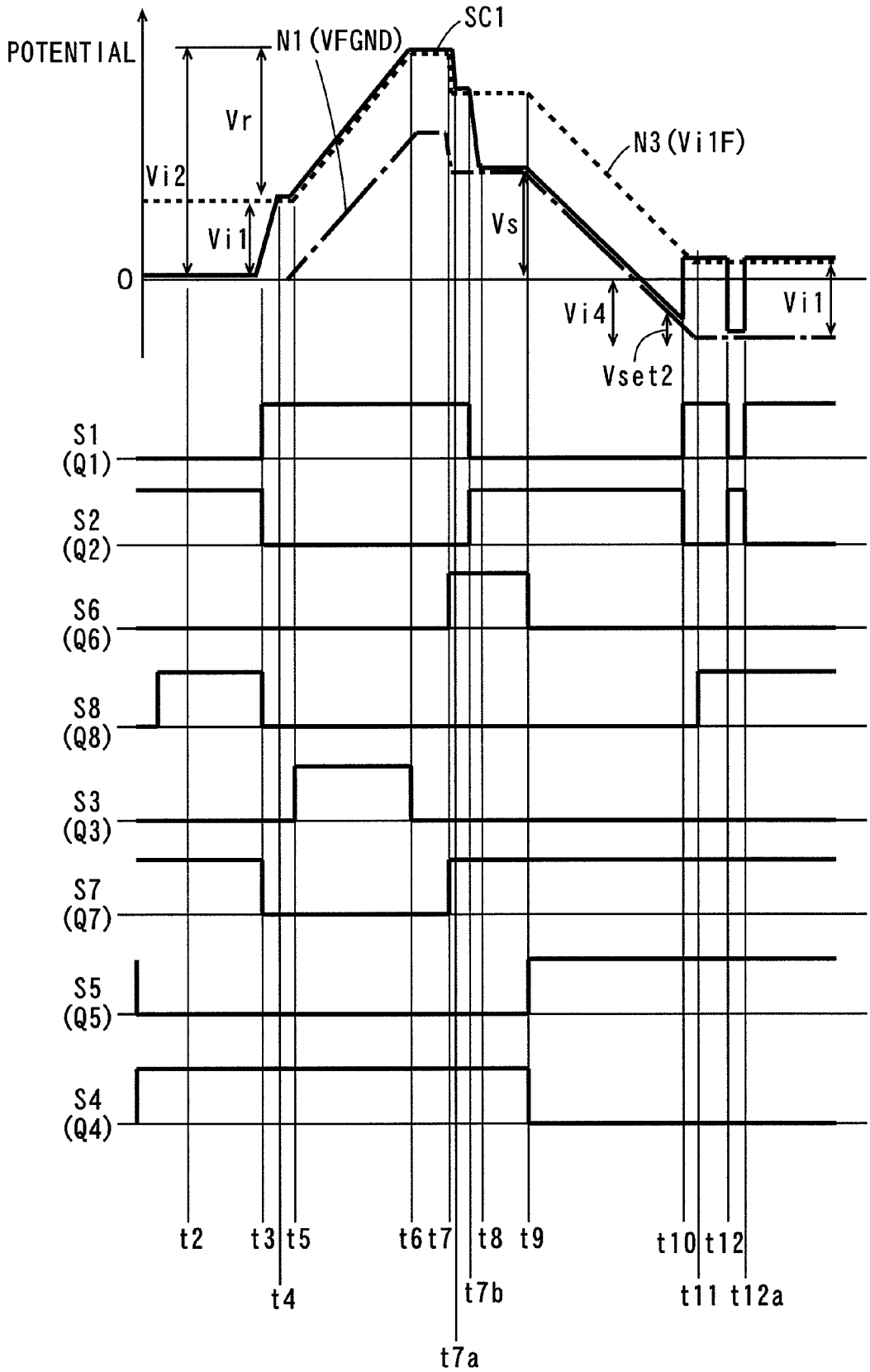
FIG. 22 is a detailed timing chart in the setup period and a write period of the first SF of FIG. 8.

FIG. 22 is a detailed timing chart in the setup period and the write period of the first SF of FIG. 8.

Change of the potential VFGND of the node N1 is indicated by the one-dot and dash line, change of the potential Vi1F of the node N3 is indicated by the dotted line, and change of the potential of the scan electrode SC1 is indicated by the solid line in the top stage of FIG. 22. Note that control signals S9*a*, S9*b* supplied to the recovery circuit 400 are not shown in FIG. 22.

At the starting time point t2 of the first SF, the control signals S1, S6, S3, S5 are at a low level, and the control signals S2, S8, S7, S4 are at a high level. This causes the transistors Q1, Q6, Q3, Q5 to be turned off and the transistors Q2, Q8, Q7, Q4 to be turned on. Thus, the node N1 attains the ground potential (0 V) and the potential Vi1F of the node N3 attains Vi1. Since the transistor Q2 is turned on, the potential of the scan electrode SC1 attains the ground potential.

The control signals S8, S7 attain a low level and the transistors Q8, Q7 are turned off at the time point t3. Moreover, the control signal S1 attains a high level, and the control signal S2 attains a low level. This causes the transistor Q1 to be turned on and the transistor Q2 to be turned off. Accordingly, the potential of the scan electrode SC1 rises to Vi1. The potential of the scan electrode SC1 is maintained at Vi1 in a period from the time point t4 to the time point t5.

The control signal S3 attains a high level and the transistor Q3 is turned on at the time point t5. This causes the potential VFGND of the node N1 to gradually rise from the ground potential to Vr. In addition, the potential Vi1F of the node N3 and the potential of the scan electrode SC1 rise from Vi1 to Vi2 (=Vi1+Vr).

The control signal S3 attains a low level and the transistor Q3 is turned off at the time point t6. This causes the potential VFGND of the node N1 to be maintained at Vr. Moreover, the potential Vi1F of the node N3 and the potential of the scan electrode SC1 are maintained at (Vi1+Vr).

The control signals S6, S7 attain a high level and the transistors Q6, Q7 are turned on at the time point t7. This causes the potential VFGND of the node N1 to drop to Vi1. In addition, the potential Vi1F of the node N3 and the potential of the scan electrode SC1 drop to (Vi1+Vs). The potential of the scan electrode SC1 is maintained at (Vi1+Vs) in the period from the time point t7*a* to the time point t7*b*.

The control signals S1 attains a low level and the control signal S2 attains a high level at the time point t7*b*. This causes the transistor Q1 to be turned off and the transistor Q2 to be turned on. Thus, the potential of the scan electrode SC1 drops to Vs. Accordingly, the potential of the scan electrode SC1 is maintained at Vs in the period from the time point t8 to the time point t9.

The control signals S6, S4 attain a low level and the transistors Q6, Q4 are turned off at the time point t9. Moreover, the control signal S5 attains a high level, and the transistor Q5 is turned on. This causes the potential VFGND of the node N1 and the potential of the scan electrode SC1 to gradually drop toward (−Vi4). In addition, the potential Vi1F of the node N3 gradually drops toward (−Vi4+Vi1).

The control signal S1 attains a high level and the control signal S2 attains a low level at the time point t10. This causes the transistor Q1 to be turned on and the transistor Q2 to be turned off. Accordingly, the potential of the scan electrode SC1 rises from (−Vi4+Vset2) to (−Vi4+Vi1). Here, Vset2<Vi1.

The control signal S8 attains a high level and the transistor Q8 is turned on at the time point t11 in the write period. This causes the node N4 to be at the ground potential. At this time, since the transistor Q4 is turned off, the node N1 and the potential of the scan electrode SC1 are sustained at (−Vi4+Vi1).

The control signal S1 attains a low level and the control signal S2 attains a high level at a time point t12. This causes the transistor Q1 to be turned off and the transistor Q2 to be turned on. Accordingly, the potential of the scan electrode SC1 drops from (−Vi4+Vi1) to −Vi4.

The control signal S1 attains a high level and the control signal S2 attains a low level at a time point t12*a*. This causes the transistor Q1 to be turned off and the transistor Q2 to be turned on. Thus, the potential of the scan electrode SC1 rises from −Vi4 to (−Vi4+Vi1). As a result, the scan pulse is generated in the scan electrode SC1.

(12-c) Operation Control in the Sustain Period

Next, description is made of the operation control of the scan electrode driving circuit 53 when the first ramp voltage is applied to the scan electrode SCi in the tenth SF of the preceding field.

Figure 23:
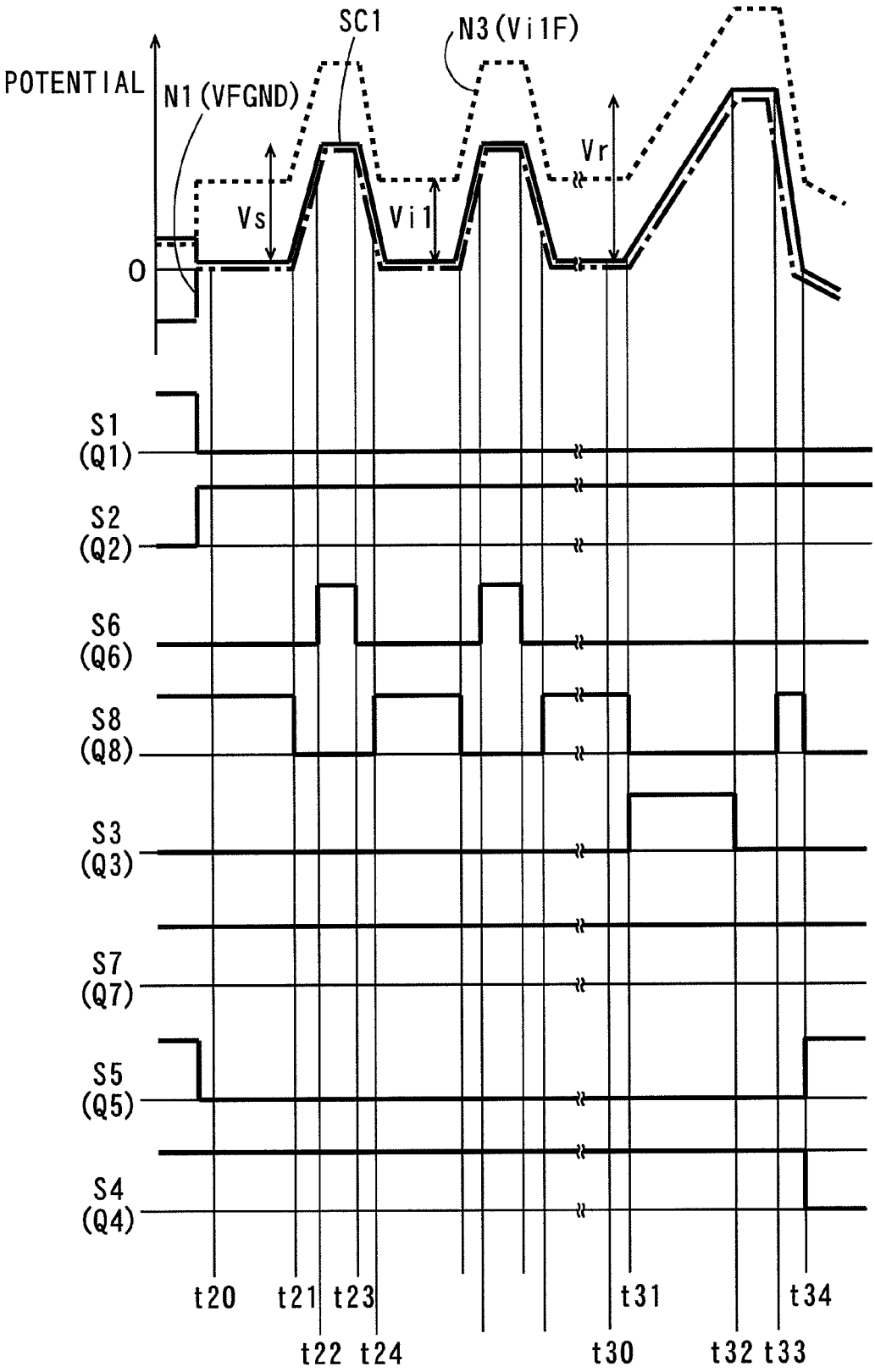
FIG. 23 is a detailed timing chart at the start and before the end of a sustain period of a tenth SF of FIG. 8.
Figure 24:
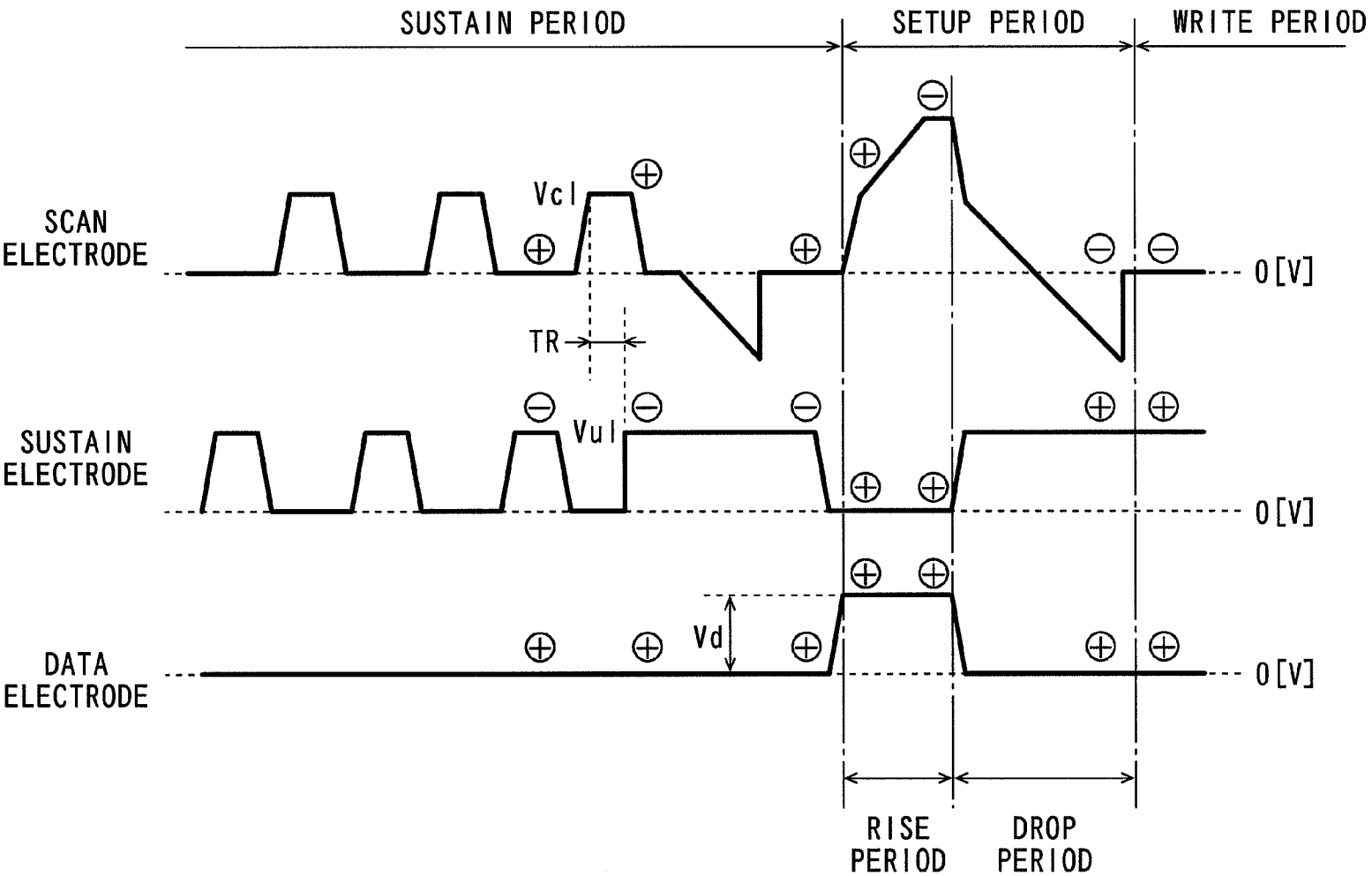
FIG. 24 PRIOR ART
FIG. 24 shows examples of drive voltage waveforms of a panel employing a method of driving the panel of Patent Document 2.
Figure 25:
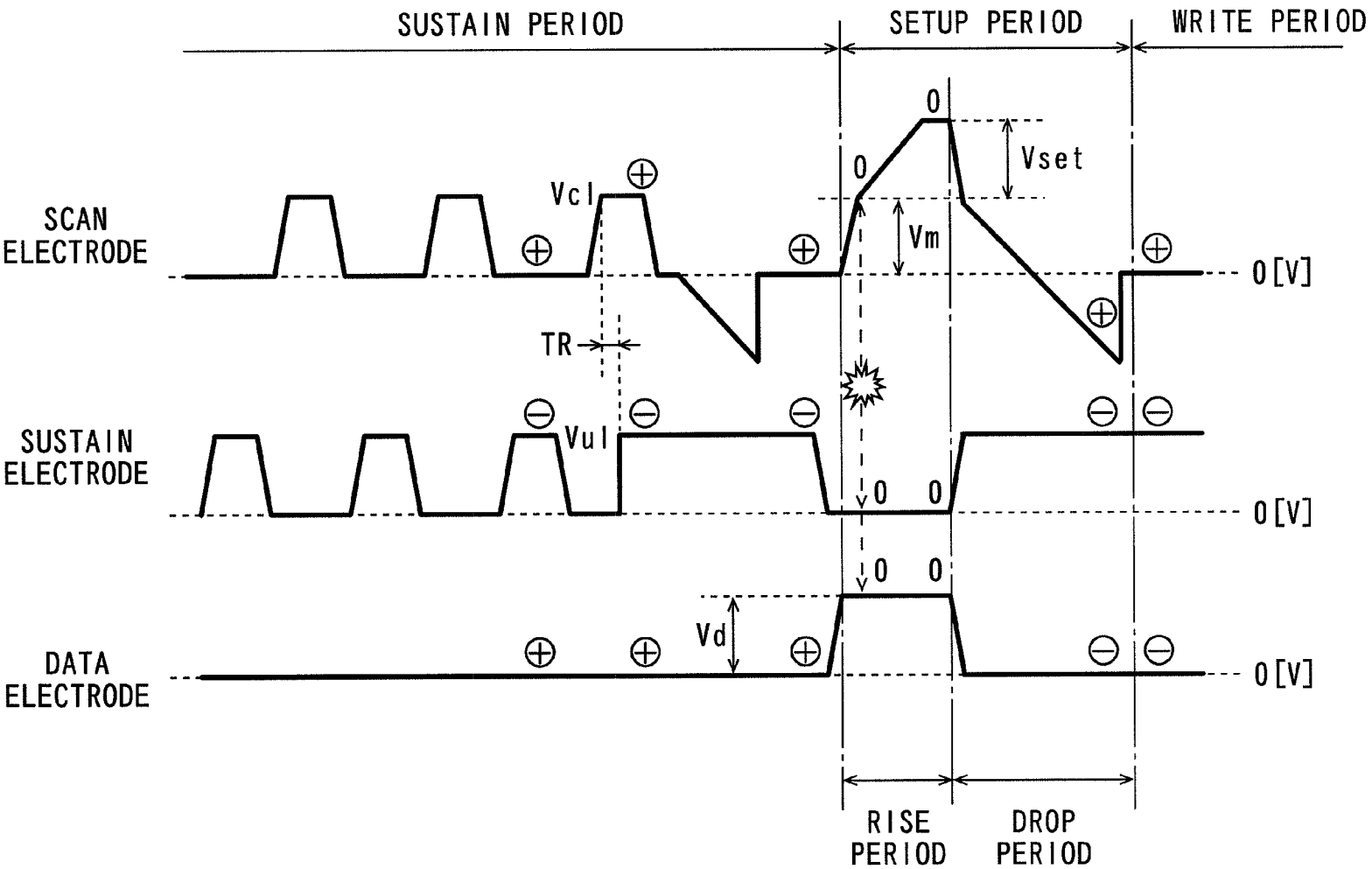
FIG. 25 PRIOR ART
FIG. 25 shows examples of driving waveforms of a panel for preventing crosstalk from occurring between adjacent discharge cells.

FIG. 23 is a detailed timing chart at the start and before the end of the sustain period of the tenth SF of FIG. 8.

Change of the potential VFGND of the node N1 is indicated by the one-dot and dash line, change of the potential Vi1F of the node N3 is indicated by the dotted line, and change of the potential of the scan electrode SC1 is indicated by the solid line in the top stage of FIG. 23. Note that the control signals S9*a*, S9*b* applied to the recovery circuit 400 are not shown in FIG. 23.

At a starting time point t20 of the sustain period, the control signals S1, S6, S3, S5 are at a low level, and the control signals S2, S8, S7, S4 are at a high level. This causes the transistors Q1, Q6, Q3, Q5 to be turned off and the transistors Q2, Q8, Q7, Q4 to be turned on. Thus, the node N1 attains the ground potential and the potential Vi1F of the node N3 attains Vi1. Since the transistor Q2 is turned on, the potential of the scan electrode SC1 attains the ground potential.

The control signals S8 attains a low level and the transistor Q8 is turned off at a time point t21. At this time, the control signal S9*a* (see FIG. 21) attains a high level, and the transistor QA is turned on. This causes the current to be supplied from the recovery capacitor CR to the node N1 and the scan electrode SC1, causing the potential VFGND of the node N1 and the potential of the scan electrode SC1 to rise.

The control signal S6 attains a high level and the transistor Q6 is turned on at a time point t22. At this time, the control signal S9*a* (see FIG. 21) attains a low level and the transistor QA is turned off. This causes the potential VFGND of the node N1 and the potential of the scan electrode SC1 to attain Vs. Moreover, the potential Vi1F of the node N3 attains (Vi1+Vs).

The control signal S6 attains a low level and the transistor Q6 is turned off at a time point t23. At this time, the control signal S9*b* (see FIG. 21) attains a high level and the transistor QB is turned on. This causes the current to be supplied from the node N1 and the scan electrode SC1 to the recovery capacitor CR, causing the potential VFGND of the node N1 and the potential of the scan electrode SC1 to drop.

The control signal S8 attains a high level and the transistor Q8 is turned on at a time point t24. At this time, the control signal S9*b* (see FIG. 21) attains a low level, and the transistor QB is turned off. This causes the potential VFGND of the node N1 and the potential of the scan electrode SC1 to attain the ground potential. In addition, the potential Vi1F of the node N3 drops to Vi1.

In this manner, the potential VFGND of the node N1 and the potential of the scan electrode SC1 alternately change between the ground potential and Vs. In addition, the potential Vi1F of the node N3 alternately changes between Vi1 and (Vi1+Vs).

The control signals S1, S6, S3, S5 are at a low level, and the control signals S2, S8, S7, S4 are at a high level at a time point t30 preceding the start of application of the first ramp voltage to the scan electrode SCi before the end of the sustain period of the tenth SF. This causes the transistors Q1, Q6, Q3, Q5 to be turned off and the transistors Q2, Q8, Q7, Q4 to be turned on. Thus, the node N1 attains the ground potential and the potential Vi1F of the node N3 attains Vi1. Since the transistor Q2 is turned on, the potential of the scan electrode SC1 attains the ground potential.

The control signal S8 attains a low level, and the transistor Q8 is turned off at a time point t31. The control signal S3 attains a high level, and the transistor Q3 is turned on. Accordingly, an RC integration circuit composed of the gate resistor RG and the capacitor CG connected to the transistor Q3 causes the potential VFGND of the node N1 and the potential of the scan electrode SC1 to gradually rise from the ground potential to Vr. The potential Vi1F of the node N3 rises from Vi1 to (Vi1+Vr).

The control signal S3 attains a low level, and the transistor Q3 is turned off at a time point t32. This causes the potential VFGND of the node N1 and the potential of the scan electrode SC1 to be held at Vr. The potential Vi1F of the node N3 is maintained at (Vi1+Vr).

The control signal S8 attains a high level, and the transistor Q8 is turned on at a time point t33. This causes the potential VFGND of the node N1 and the potential of the scan electrode SC1 to attain the ground potential. The potential Vi1F of the node N3 drops to Vi1.

The control signal S5 attains a high level, and the transistor Q5 is turned on at a time point t34. The control signals S8, S4 attain a low level, and the transistors Q8, Q4 are turned on. This causes the potential VFGND of the node N1 and the potential of the scan electrode SC1 to gradually drop from the ground potential. The potential Vi1F of the node N3 drops from (Vi1+Vr) to Vi1.

As described above, the voltage Vr that is higher than the voltage Vs of the sustain pulse is applied to the scan electrode SCi as the first ramp voltage for generating the weak erase discharge between the sustain electrode SUi and the scan electrode SCi before the end of the sustain period of the sub-field immediately before the sub-field in which the setup for all the cells is performed in the scan electrode driving circuit 53 of this example.

Although not shown, the voltage Vs that is the same as the voltage of the sustain pulse is applied to the scan electrode SCi as the second ramp voltage for generating the weak erase discharge between the sustain electrode SUi and the scan electrode SCi before the end of the sustain period in the sub-field immediately before the sub-field in which the selective setup is performed.

(13) Effects

In the plasma display device according to the present embodiment, the positive voltage Vd is applied to the data electrode Dj before the time point t3 (FIGS. 5, 6, 10) where the scan electrode SCi rises to the positive voltage Vi1 in the setup period where the setup operation for all the cells is performed. This causes the strong discharge to be generated between the sustain electrode SUi and the data electrode Dj.

Thus, even though the large amount of the negative wall charges remain on the sustain electrode SUi because of the weak erase discharge generated before the setup for all the cells, the strong discharge is prevented from being generated between the scan electrode SCi and the sustain electrode SUi at the time of application of the ramp voltage to the scan electrode SCi.

Since the appropriate amount of wall charges remains on the scan electrode SCi, the voltage between the scan electrode SCi and the sustain electrode SUi reliably exceeds the discharge start voltage with rising the ramp voltage. As a result, the weak setup discharge is generated between the scan electrode SCi and the sustain electrode SUi in the setup period, and the wall charges on each of the electrodes SCi, SUi are reliably adjusted to the desired amount.

Moreover, the data electrode Dj is held at the voltage Vd during a period where the ramp voltage gradually rises, thus preventing the strong discharge from being generated between the scan electrode SCi and the data electrode Dj.

Furthermore, the weak erase discharge between the scan electrode SCi and the sustain electrode SUi causes the wall charges on the scan electrode SCi and the wall charges on the sustain electrode SUi to be decreased before the start of the setup period. This allows the large amount of positive wall charges to remain on the scan electrode SCi and the large amount of negative wall charges to remain on the sustain electrode SUi. Accordingly, the write discharges between the scan electrode SCi and the data electrode Dj and between the sustain electrode SUi and the scan electrode SCi are weakened in the write period after the setup period. As a result, the occurrence of the crosstalk between the adjacent discharge cells DC is prevented even though the distances between the adjacent discharge cells DC are small.

The second ramp voltage may be applied to the scan electrode SCi while the sustain electrode SUi and the data electrode Dj are held at the ground potential, and the first ramp voltage that is higher than the second ramp voltage may be applied to the scan electrode SCi while the sustain electrode SUi and the data electrode Dj are held at the ground potential before the end of the sustain periods of the SFs excluding the last SF.

In this case, the negative wall charges stored on the sustain electrode SUi is reliably decreased by the predetermined amount even when the weight amount in the last lighting SF of the preceding field is small. As a result, the setup discharge can be stably performed, and low gray levels can be clearly displayed.

(14) Others Examples (14-a)

As shown in FIG. 5, for example, the pulsed positive voltage Vd is applied to the data electrode Dj at the starting time point t2 of the setup period in this plasma display device. The foregoing operation is performed in order to cause the data electrode Dj to be held at the ground potential when the ramp voltage rising from Vi1 to Vi2 is applied to the scan electrode SCi at the time point t3. This prevents generation of ripples at the time of the rise of the ramp voltage. Accordingly, an IC (Integrated Circuit) with a low breakdown voltage can be used in the plasma display device.

Thus, the positive voltage Vd applied to the data electrode Dj may not be pulsed when the IC (Integrated Circuit), which is a constituent of the plasma display device, has a high breakdown voltage. That is, the positive voltage Vd may be continuously applied to the data electrode Dj during application of the ramp voltage to the scan electrode SCi (a period from the time point t2 to the time point t9, for example).

(14-b)

While the n-channel FETs and the p-channel FETs are employed as switching elements in the data electrode driving circuit 52, the scan electrode driving circuit 53 and the sustain electrode driving circuit 54 in the above-described embodiment, the switching elements are not limited to the foregoing examples.

For example, a p-channel FET, an IGBT (Insulated Gate Bipolar Transistor) or the like may be employed instead of the n-channel FET, and an n-channel FET, an IGBT (Insulated Gate Bipolar Transistor) or the like may be employed instead of the p-channel FET in the above-described circuits.

(15) Correspondences between Elements in the Claims and Parts in Embodiments

In the following paragraph, non-limiting examples of correspondences between various elements recited in the claims below and those described above with respect to various preferred embodiments of the present invention are explained.

In the foregoing embodiments, the voltage Vi1 and the voltage Vs of FIG. 20 are examples of a first potential, the voltage Vi2 and the voltage (Vs+Vr') of FIG. 20 are examples of a second potential, the voltage Ve1 is an example of a third potential, the ground potential is an example of a fourth potential, the ground potential is an example of a fifth potential, the voltage Vd is an example of a sixth potential, the voltage Vr is an example of a seventh potential, the voltage Vs is an example of an eighth potential, the time point t3 of FIGS. 5, 6, 10 is an example of a starting time point where the potential of the scan electrode changes to the first potential.

As each of various elements recited in the claims, various other elements having configurations or functions described in the claims can be also used.

[Industrial Applicability]

The present invention is applicable to a display device that displays various images.

The invention claimed is:

1. A plasma display device that drives a plasma display panel including a plurality of discharge cells at intersections of a scan electrode and a sustain electrode with a plurality of data electrodes by a sub-field method in which one field period includes a plurality of sub-fields, comprising:

a scan electrode driving circuit that drives said scan electrode;

a sustain electrode driving circuit that drives said sustain electrode; and a data electrode driving circuit that drives said data electrodes, wherein at least one sub-field of said plurality of sub-fields includes a first setup period where wall charges of said plurality of discharge cells are adjusted so that write discharges can be performed, said scan electrode driving circuit applies a ramp voltage that changes from a first potential to a second potential, to said scan electrode for setup discharges in said first setup period, said sustain electrode driving circuit applies a voltage that changes from a third potential to a fourth potential, to said sustain electrode before a time point where a potential of said scan electrode starts changing to said first potential so that a potential difference between said scan electrode and said sustain electrode is decreased, and said data electrode driving circuit applies to each of the data electrodes a voltage that changes from a fifth potential to a sixth potential before the time point where the potential of said scan electrode starts changing to said first potential so that a potential difference between said sustain electrode and each of the data electrodes is increased in synchronization with a change in a voltage of said sustain electrode, causes the voltage of each of the data electrodes to change from said sixth potential to said fifth potential before the time point where the potential of said scan electrode starts changing to said first potential, and subsequently causes the voltage of each of the data electrodes to return to said sixth potential after the time point where the potential of said scan electrode starts changing to said first potential.

2. The plasma display device according to claim 1, wherein said data electrode driving circuit maintains a voltage of each of the data electrodes at said sixth potential during application of said ramp voltage.

3. The plasma display device according to claim 1, wherein said second potential is a positive potential that is higher than said first potential, said third potential is a positive potential that is higher than said fourth potential, and said sixth potential is a positive potential that is higher than said fifth potential.

4. The plasma display device according to claim 1, wherein said fourth potential and said sixth potential are set so that a first discharge is generated between said sustain electrode and each of the data electrodes, said ramp voltage is set so that a second discharge is generated between said scan electrode and said sustain electrode during change in said ramp voltage from said first potential to said second potential after said first discharge, and a discharge current in said second discharge is smaller than a discharge current in said first discharge.

5. The plasma display device according to claim 1, wherein said scan electrode driving circuit applies a pulse voltage having a seventh potential to said scan electrode at an end of a sustain period preceding said first setup period, and said sustain electrode driving circuit applies a voltage that changes from said fourth potential to said third potential to said sustain electrode during a period of application of said pulse voltage in order to decrease wall charges of a discharge cell in which a sustain discharge has been performed.

6. A plasma display device that drives a plasma display panel including a plurality of discharge cells at intersections of a scan electrode and a sustain electrode with a plurality of data electrodes by a sub-field method in which one field period includes a plurality of sub-fields, comprising:

a scan electrode driving circuit that drives said scan electrode;

a sustain electrode driving circuit that drives said sustain electrode; and a data electrode driving circuit that drives said data electrodes, wherein a first sub-field of the plurality of sub-fields in the one field period includes a first setup period where wall charges of said plurality of discharge cells are adjusted so that write discharges can be performed, a sub-field of the plurality of sub-fields not including said first setup period includes a second setup period where the wall charges of a discharge cell, which has been subjected to a sustain discharge, of said plurality of discharge cells are adjusted so that the write discharge can be performed, said scan electrode driving circuit applies a ramp voltage that changes from a first potential to a second potential, to said scan electrode for setup discharges in said first setup period, said sustain electrode driving circuit applies a voltage that changes from a third potential to a fourth potential, to said sustain electrode before a time point where a potential of said scan electrode starts changing to said first potential so that a potential difference between said scan electrode and said sustain electrode is decreased, said data electrode driving circuit applies to each of the data electrodes a voltage that changes from a fifth potential to a sixth potential before the time point where the potential of said scan electrode starts changing to said first potential so that a potential difference between said sustain electrode and each of the data electrodes is increased in synchronization with change in a voltage of said sustain electrode, said scan electrode driving circuit further applies a first ramp pulse voltage having a seventh potential to said scan electrode at an end of a sustain period preceding said first setup period in order to decrease wall charges of the discharge cell in which the sustain discharge has been performed, a leading edge of said first ramp pulse voltage changes more gradually than a trailing edge of the first ramp pulse voltage, said sustain electrode driving circuit further causes said sustain electrode to be held at said fourth potential during a period of application of said first ramp pulse voltage, said scan electrode driving circuit further applies a second ramp pulse voltage having an eighth potential to said scan electrode for decreasing the wall charges of the discharge cell that has been subjected to the sustain discharge at the end of the sustain period preceding said second setup period, a leading edge of said second ramp pulse voltage changes more gradually than a trailing edge of the second ramp pulse voltage, said sustain electrode driving circuit further causes said sustain electrode to be held at said fourth potential during a period of application of said second ramp pulse voltage, and said seventh potential is higher than said eighth potential.

7. A method of driving a plasma display device that drives a plasma display panel including a plurality of discharge cells at intersections of a scan electrode and a sustain electrode with a plurality of data electrodes by a sub-field method in which one field period includes a plurality of sub-fields, the method comprising:

driving the scan electrode;

driving the sustain electrode; and driving the data electrodes, wherein at least one sub-field of the plurality of sub-fields includes a setup period where wall charges of the plurality of discharge cells are adjusted so that write discharges can be performed, the driving the scan electrode includes applying a ramp voltage that changes from a first potential to a second potential, to the scan electrode for setup discharges in the setup period, the driving the sustain electrode includes applying a voltage that changes from a third potential to a fourth potential, to the sustain electrode so that a potential difference between said scan electrode and said sustain electrode is decreased before a time point where a potential of the scan electrode starts changing to the first potential, and the driving the data electrodes includes applying a voltage that changes from a fifth potential to a sixth potential, to each of the data electrodes so that a potential difference between the sustain electrode and each of the data electrodes is increased in synchronization with change in a voltage of the sustain electrode before the time point where the potential of the scan electrode starts changing to the first potential, causing the voltage of each of the data electrodes to change from the sixth potential to the fifth potential before the time point where the potential of the scan electrode starts changing to the first potential, and subsequently causing the voltage of each of the data electrodes to return to the sixth potential after the time point where the potential of the scan electrode starts changing to the first potential.

8. A method of driving a plasma display device that drives a plasma display panel including a plurality of discharge cells at intersections of a scan electrode and a sustain electrode with a plurality of data electrodes by a sub-field method in which one field period includes a plurality of sub-fields, the method comprising:

driving the scan electrode;

driving the sustain electrode; and driving the data electrodes, wherein a first sub-field of the plurality of sub-fields in the one field period includes a first setup period where wall charges of the plurality of discharge cells are adjusted so that write discharges can be performed, a sub-field of the plurality of sub-fields not including the first setup period includes a second setup period where the wall charges of a discharge cell, which has been subjected to a sustain discharge, of the plurality of discharge cells are adjusted so that the write discharge can be performed, the driving the scan electrode includes applying a ramp voltage that changes from a first potential to a second potential, to the scan electrode for setup discharges in the first setup period, the driving the sustain electrode includes applying a voltage that changes from a third potential to a fourth potential, to the sustain electrode before a time point where a potential of the scan electrode starts changing to the first potential so that a potential difference between the scan electrode and the sustain electrode is decreased, the driving the data electrode includes applying to each of the data electrodes a voltage that changes from a fifth potential to a sixth potential before the time point where the potential of the scan electrode starts changing to the first potential so that a potential difference between the sustain electrode and each of the data electrodes is increased in synchronization with change in a voltage of the sustain electrode, the driving the scan electrode further includes applying a first ramp pulse voltage having a seventh potential to the scan electrode at an end of a sustain period preceding the first setup period in order to decrease wall charges of the discharge cell in which the sustain discharge has been performed, a leading edge of the first ramp pulse voltage changes more gradually than a trailing edge of the first ramp pulse voltage, the driving the sustain electrode further includes causing the sustain electrode to be held at the fourth potential during a period of application of the first ramp pulse voltage, the driving the scan electrode further includes applying a second ramp pulse voltage having an eighth potential to the scan electrode for decreasing the wall charges of the discharge cell that has been subjected to the sustain discharge at the end of the sustain period preceding the second setup period, a leading edge of the second ramp pulse voltage changes more gradually than a trailing edge of the second ramp pulse voltage, the driving the sustain electrode further includes causing the sustain electrode to be held at the fourth potential during a period of application of the second ramp pulse voltage, and the seventh potential is higher than the eighth potential.

* * * * *